US010739088B2

(12) United States Patent
Norlin

(10) Patent No.: US 10,739,088 B2
(45) Date of Patent: Aug. 11, 2020

(54) APPARATUS FOR HEATING GAS

(71) Applicant: Petrus Norlin, Nacka (SE)

(72) Inventor: Petrus Norlin, Nacka (SE)

( * ) Notice: Subject to any disclaimer, the term of this patent is extended or adjusted under 35 U.S.C. 154(b) by 90 days.

(21) Appl. No.: 15/673,332

(22) Filed: Aug. 9, 2017

(65) Prior Publication Data

US 2018/0045473 A1 Feb. 15, 2018

Related U.S. Application Data

(63) Continuation-in-part of application No. PCT/SE2017/000031, filed on Jul. 12, 2017, and a continuation-in-part of application No. PCT/SE2017/000032, filed on Mar. 8, 2017.

(60) Provisional application No. 62/372,709, filed on Aug. 9, 2016.

(51) Int. Cl.

| | |
|---|---|
| ***F24F 13/06*** | (2006.01) |
| ***F28F 13/06*** | (2006.01) |
| ***F24H 3/00*** | (2006.01) |
| ***F28F 13/10*** | (2006.01) |
| ***F28F 7/00*** | (2006.01) |
| *F28D 20/00* | (2006.01) |
| *F28F 13/00* | (2006.01) |

(52) U.S. Cl.

CPC ..... *F28F 13/06* (2013.01); *F24H 3/00* (2013.01); *F28F 7/00* (2013.01); *F28F 13/10* (2013.01); *F28D 2020/0082* (2013.01); *F28D 2020/0095* (2013.01); *F28F 2013/008* (2013.01); *F28F 2250/08* (2013.01); *F28F 2250/106* (2013.01); *F28F 2270/00* (2013.01)

(58) Field of Classification Search

CPC ..... F28F 13/06; F28F 13/10; F28F 2210/04; F24H 3/00; F24H 3/004; F28D 7/0075; F28D 7/0091

See application file for complete search history.

(56) References Cited

U.S. PATENT DOCUMENTS

| | | | | |
|---|---|---|---|---|
| 2,622,849 | A * | 12/1952 | Laing | F25D 31/005 165/267 |
| 8,656,712 | B2 * | 2/2014 | Howes | F01K 3/12 60/515 |
| 2009/0077961 | A1 * | 3/2009 | Baker | F01K 3/06 60/520 |
| 2010/0089063 | A1 * | 4/2010 | McBride | F15B 11/032 60/682 |
| 2017/0219293 | A1 * | 8/2017 | Kreuger | F28D 15/00 |
| 2018/0142577 | A1 * | 5/2018 | Ortmann | F01K 3/006 |

FOREIGN PATENT DOCUMENTS

| | | | | |
|---|---|---|---|---|
| WO | WO-2009044139 A2 * | 4/2009 | | F01K 3/06 |

* cited by examiner

*Primary Examiner* — Tho V Duong

(74) *Attorney, Agent, or Firm* — KA Filing LLC; Wayne V. Harper

(57) ABSTRACT

An apparatus for heating gas utilizes a series of chambers through which a gas volume is advanced, and a gradational heat transfer element which enables incremental heat transfer to the gas volume as the gas volume is advanced through the chambers.

33 Claims, 29 Drawing Sheets

APPARATUS FOR HEATING GAS

The current application claims a priority to the U.S. Provisional Patent application Ser. No. 62/372,709 filed on Aug. 9, 2016. The current application further claims a priority to the Swedish Utility Patent application serial number 1630113-7 filed on Jul. 20, 2016. The current application further claims a priority to the Patent Cooperation Treaty application serial number PCT/2017/000031 filed on Jul. 12, 2017. The current application further claims a priority to the Patent Cooperation Treaty application serial number PCT/SE2017/000032 filed on Aug. 3, 2017.

FIELD OF THE INVENTION

The present invention relates generally to heat exchange. More particularly, the present invention relates to a heat transfer device for heating gas with maximal efficiency for reduced energy loss.

BACKGROUND OF THE INVENTION

When using refrigerant in different contexts, it's often desirable to transfer the heat from a fluid to another without physically mixing the fluids. This may be because one is dirty or that it is simply different types of cold media. Counter-flow heat exchangers (CFHEs) are among the most energy efficient.

This type of flow arrangement allows the largest change in temperature of both fluids and is therefore most efficient (where efficiency is the amount of actual heat transferred compared with the theoretical maximum amount of heat that can be transferred).

Referring to ex FIG. 27, one can see that cold fluid automatically gets exposed to hotter sections the hotter the fluid gets, and it is possible for the heated cold fluid to have an output temperature (TcOut) to be close to the Hot fluid input temperature (ThIn).

Attempting to accomplish the same result with two gases, alternatively warming up a gas using a liquid with a CFHE, raises a number of problems.

Referring to FIG. 27, given two gases pumped counter flowingly in a heat exchanger, in the flow moving from cold to warm, the gas at the front would be hottest and thus get higher pressure. Due to the pressure difference in the cold and hot gas, some of the hot gas will tend to move/expand backwards against the intended flow direction (se arrows pointing right in flow B), resulting in some mixing of the cold gas and hot gas and counteracting the flow. Furthermore, the expansion will cool down the gas that is supposed to be heated. To summarize you tend to get an output temperature TcOut lower than, if it had been liquid, due to expansion and mixture of cold and hot gas in the heated flow (B), also often with lower output density (DcOut) which often can be un-preferred.

The interest in developing an apparatus that performs something functionally similar to a counterflow heat exchanger that works well on gas should be of interest. To show that this is a real and hard-to-solve problem, and not "obvious to a person skilled in the art", refer to Wikipedia, where at some point it was said that "counterflow heat exchangers do not work well when heating gas" In addition, for the purpose of explaining the difficulty of the problem, a number of solutions to the problem will be described which at first glance may seem to work well, describing the disadvantages of these solutions. Wikipedia is not a scientific journal or the like, but at least it gives an indication that an effective equivalent of a counterflow heat changer for heating gas is difficult to create.

The following problems also occurs in when trying to perform the same task with a small amount of liquid flowing counterflowly against a gas being heated up (referring to FIG. 27, this would mean that flow A is liquid).

1. Referring to FIG. 32, if you were to use a fan (F) to press the cold gas towards a high pressure flow, (assuming the density Dcin=Dcout) work has to be added by the fan since the pressure (Pcout) will increase with constant density and increased temperature 2. Referring to FIG. 27, if you, when using a fan, allow the heated gas to expand to such an extent that the heated gas has the same pressure as the cold gas (Dcin>Dcout), you might not have to add, the above described, extra work, and the gas might not counteract the desired flow, but we are then talking about isobar heating of the gas, which requires more energy for the same degree of heating compared to isochor heating. Furthermore, the heated gas will have lower density than the cold gas, which in some cases aren't desirable.

3. Separating the different parts, each with a different temperature with check valves, only allowing movements from cold to hot, the gases will not be mixed. However, the warmer parts will have high pressure and, as in point 1, work must be added to press in the cold gas towards the warmer gas. Furthermore, check valves usually have a certain cracking pressure, which means you have to apply force to overcome that cracking pressure.

4. Another problem which would interfere with this procedure is that gas has low mass compared with the heat exchanger. To heat up the gas one must, at least, warm up the wall between the gas and liquid to be able to lead the heat to the gas. If a certain position of a walls are cooled/heated interchangedly, this energy has to be added, and the mass of the wall is probably large compared to the gas.

In order to describe this problem (4), a few less appropriate solutions to problem 1 and 3 are described, Assume you try to address the problem colder gas mixing with hotter while heating by moving a whole volume of gas. The whole volume having substantially the same temperature at given point in time. Referring to FIG. 33, assume that the cup (C) in the FIG. 33 contains a gas to be heated and that gas volume is sealingly enclosed on the board (T). The board (T) comprises temperatures gradationally increasing from position A (coldest) to B (hottest). By sliding the cup along the board from A to B, the gas will be exposed to incrementally higher temperatures, as in a counterflow heat exchanger, still without having to apply any work on the gas to move it towards hotter sections, except for friction. The drawback is off course that you heat up the cup at the same time, and the mass of the cup is likely bigger than the gas.

In another solution the gas is stationary, and a fluid of varying temperature is flushed through the container, taking the heat from one gas and transferring it to another gas. This solves the problem of the gas counteracting the flow since the gas is stationary and instead liquid is flowing through the container. This raises a number of other issues instead due to the fact that you have to warm up the container while warming up the gas. The disadvantages of this solution are described below:

Referring to FIG. 28: A half bad solution for an optimal heat exchanger is a long flow of liquid refrigerant with a maximum temperature of =<Tmaxgas−Tt (the minimum temperature difference required for heat transfer) continuously declining to a minimum gas temperature, Tmingas.

With the temperature falling decrementally, depending on the position in the liquid flow will automatically adjust to the optimum temperature difference Td for current flow rate.

If hot gas container GC1 is to transfer heat to a cold gas container GC2 this can be accomplished by this long fluid passing through a container with incrementally decreasing (or increasing depending on which direction you flow the liquid) temperatures. Assume the long fluid have temperatures varying from close to Tcg1 (*hot*) decreasingly down to Tcg2 (cold).

Let's assume this fluid is flushed through CG1 exposing it to colder and colder temperatures as CG1 loses its heat, as it would if it was cooled in a Counterflow Heat exchanger. In every position of the fluid, the fluid will increase slightly in temperature, unless the temperature difference is less than Tt. Assume the max temperature after the flushing to be Tcg1max−Td, meaning it was less or equal to this when it started.

This extra heat in the fluids different positions is then to be transferred to the cold gas container GC2. This gas container ('the containers are also assumed to be a heat exchangers) is the flushed with the same fluid backwards. Meaning it gets exposed to fluid of increasing temperatures in small steps, as if the gas was heated in a CFHE, without the turbulence/mixing/added work-problems described above. Assume Tt=0.5, meaning that the temperature of the gas in GC2 (with the above assumption) will maximally be Tcg1max−(2*Tt). The problem is that the container GC2, or at least part of the container will also be heated. To heat up the gas in GC2 to be Tgc1max, you also have to heat up the container GC2 or at least part of the container (minimum the wall between gas and liquid).

So to heat up GC2 you need to add the energy (Mass of GC2+Mass of Gas)*specific heat capacity*1. Had we "only" cooled down and warmed up the gas, i.e. completely isolated the heat exchanger from heat change, the energy needed would "only" have to be: (Mass of Gas)*specific heat capacity*1. But how can that be done? At least the heat-conducting wall between gas and liquid in a heat exchanger must be warmed up, otherwise it does not transfer the heat from the fluid to the gas.

If instead each position in a heat exchanger have a target temperature, which it reaches at equilibrium; this position loses energy to the gas that is heated, the lost energy in the heat exchanger is then added by the warmer refrigerant, i.e. only the same energy which is delivered to the gas (heated) needs to be added to the container and no more. That means that because the walls with mainly fixed temperature are still, gas need to be moved toward the warmer positions instead, with the problems that this entails.

The problem remains on how to move the gas towards positions exposing it to higher temperatures, without gas turbulence and mixing of cold and hot gas, without having to add force to pump it there, without having to heat the elements responsible for the movements.

The present invention will solve these problems and also display an appropriate method to transfer the heated gas to another device or a tank.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention.

The present invention disclosed herein is an apparatus for heating gas. While the apparatus may potentially be used for liquids, the primary application of the present invention is for the purpose of heating gas. The specific element or compound to be heated in its gas form is not necessarily limited to any specific substance, but the focus of the present invention on heat exchange with gas is due to the fact that liquids are much denser than gases and have a higher heat capacity and heat exchange rate, thus gases are more difficult to accomplish heat exchange with. The present invention seeks to provide a solution to this problem. In general, the solution presented by the present invention uses many small incremental increases in temperature in the gas to be heated. This can be accomplished through several separate chambers or containers through which the gas is advanced, each chamber or container imparting a slightly higher temperature to the gas. Furthermore, the gas is restricted to unidirectional flow as it is advanced through the chambers in order to prevent hotter gas from moving backward in the series and mixing with colder gas, producing inefficiencies.

Figure 1:
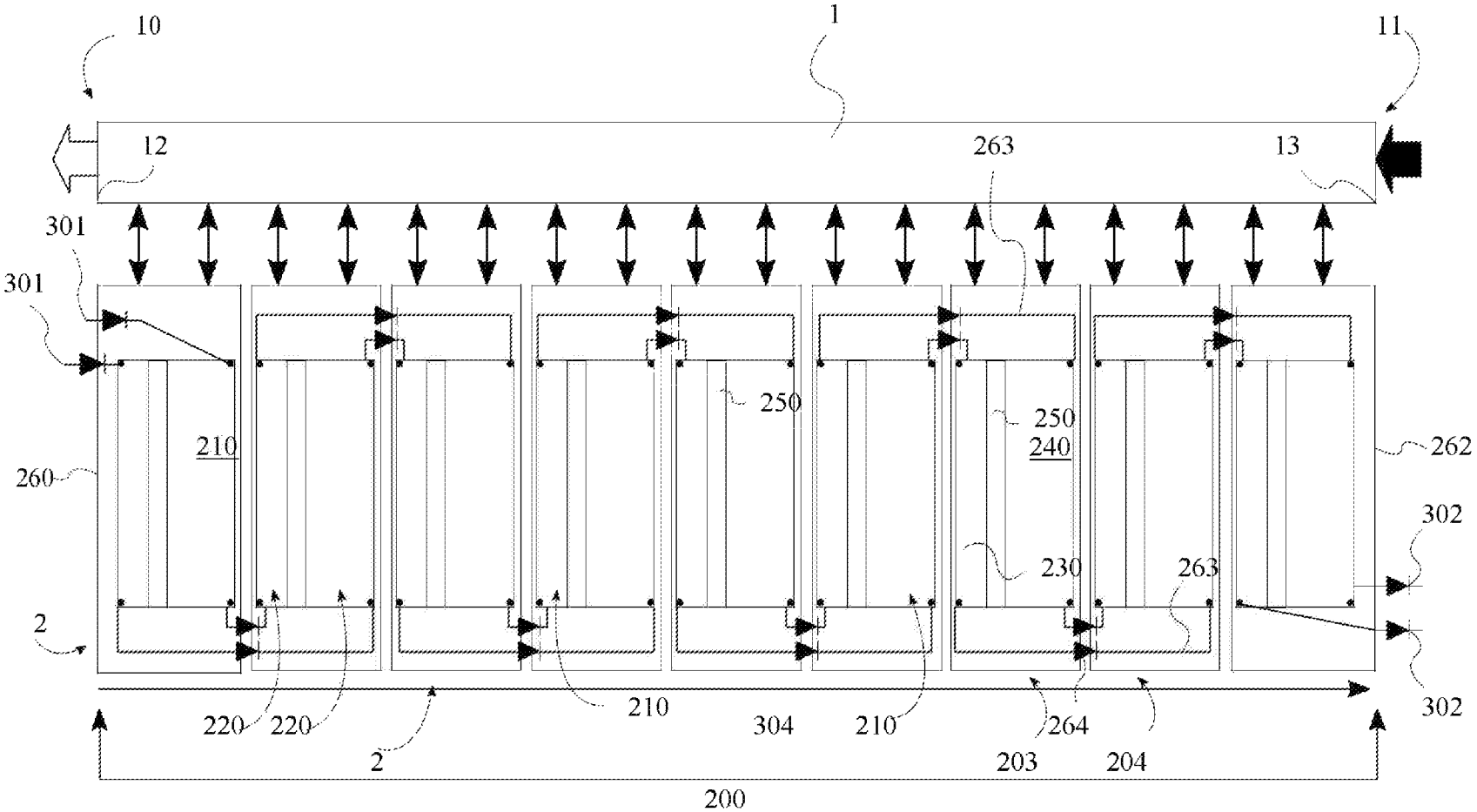
FIG. 1 is a diagram of one embodiment of the first embodiment of the heating section.

Referring to FIG. 1, in general, the present invention comprises a gradational heat transfer element 1 comprising a temperature gradient traversing along the gradational heat transfer element 1 between a cold end 10 and a hot end 11 of the gradational heat transfer element 1. It should be noted that the present invention may comprise more than one gradational heat transfer element in various embodiments and configurations. In some embodiments, the gradational heat transfer element 1 is a singular apparatus. In some embodiments, the gradational heat transfer element 1 may be a combination of apparatuses serving the same purpose.

The present invention further comprises at least one container 2 with at least one input 21 and at least one input 22, as well as at least one gas volume being sealingly enclosed within the at least one container 2. Each of the at least one container 2 is configured to advance the at least one gas volume along the temperature gradient from the cold end 10 to the hot end 11 of the gradational heat transfer element 1, wherein the at least one gas volume is exposed to gradually increasing temperatures from the gradational heat transfer element 1 along the temperature gradient.

The present invention may comprise two generally preferred embodiments of a gas heating unit by advancing the gas volume in order to receive heat energy from incrementally higher temperatures provided by the gradational heating element. It should be noted that in some embodiments, the difference between containers and chambers is inconsequential and interchangeable, as any given container can have a single chamber or multiple separated chambers within the same container. Further specific embodiments will be disclosed further hereinafter. Furthermore, the specific means of transferring gas between containers and/or chambers may vary, and may comprise any useful and appropriate means of pumping. However, one specific means of pumping gas between containers and/or chambers is disclosed further on herein. Said two preferred embodiments represent different means of accomplishing the purpose of incrementally heating a gas volume by advancing the gas volume through the gas heating unit. Said gas heating unit in its various embodiments may further be arranged in conjunction with other apparatuses utilizing similar means to produce a more robust cyclical system for heating and/or cooling gas, as will be discussed further hereinafter.

In some embodiments, at least one of the at least one container 2 is configured to traverse along the gradational heat transfer element 1 from the cold end 10 to the hot end 11, wherein each of the gas volumes within the containers are exposed to gradually increasing temperatures along the temperature gradient. Furthermore, the input and the output of each container may be configured to open and close at designated positions along the gradational heat transfer element 1. With this design, the same volume of gas is transported within the same container or combination of containers along the gradational heat transfer element 1 in order to receive incrementally higher temperatures.

The at least one container 2 comprises a series of containers 200, wherein each of the series of containers 200 comprises at least one chamber 210 and at least one gas volume. Furthermore, an arbitrary container 203 or chamber of the series of containers 200 is configured to direct fluid into a subsequent container 204 or chamber of the series of containers 200, wherein the gas volume is defined by the sum of an arbitrary subvolume defined by the arbitrary container 203 or chamber and a subsequent subvolume defined by the subsequent container 204 or chamber, wherein the arbitrary subvolume and the subsequent subvolume are each volume-variable.

Figure 2:
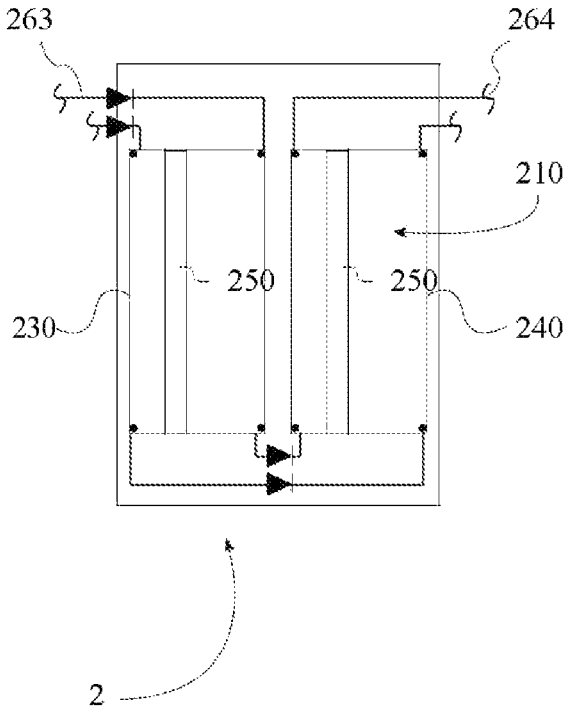
FIG. 2 is a diagram illustrating a container with an arbitrary chamber and a subsequent chamber.

Referring to FIG. 2, in some embodiments, the arbitrary chamber 230 and the subsequent chamber 240 each comprise at least one moveable element 250, wherein the moveable element 250 controls the size of each of the arbitrary subvolume and the subsequent subvolume. The moveable element 250 represents the means for pumping gas between chambers and/or containers. The moveable element 250 may be configured to translate within the container for each of the series of containers 200. In some embodiments, the moveable element 250 is configured to translate reciprocatingly within the container. In some embodiments, the moveable element 250 of the arbitrary chamber 230 is constrained to move synchronously with the moveable element 250 of the subsequent chamber 240, wherein fluid is directed from the arbitrary chamber 230 into the subsequent chamber 240 through synchronous movement of the moveable element 250 of the arbitrary chamber 230 and of the moveable element 250 of the subsequent chamber 240. The combined motion of the moveable element 250 of the arbitrary chamber 230 and of the subsequent chamber 240 function together in order to simultaneously expel gas from the arbitrary chamber 230 into the subsequent chamber 240. The moveable element 250 produces a pumping action resulting in the movement of the gas. The specific nature of the moveable element 250 should not be restricted in the present invention so long as the desired purpose is accomplished. However, one specific embodiment of the moveable element 250 is described further on in the present disclosure.

In some embodiments, the arbitrary chamber 230 and the subsequent chamber 240 are each contained within one of the series of containers, as illustrated in FIG. 2. In some embodiments, the arbitrary chamber 230 and the subsequent chamber 240 are positioned within different containers, as can be seen in FIG. 1. In some embodiments, the arbitrary chamber 230 is contained within an arbitrary container 203 from the series of containers 200, and the subsequent chamber 240 is contained within a subsequent container 204 from the series of containers 200, wherein the arbitrary container 203 precedes the subsequent container 204 in the series of containers 200.

In some embodiments, each of the series of containers 200 is in unidirectional fluid communication with each other along a fluid flow path 304, with the fluid flow path 304 being in thermal communication along the gradational heat transfer element 1. The fluid flow path 304 may be regarded as a general conception of the path along which gas is advanced in order to receive increasing amounts of heat energy from the gradational heat transfer element 1.

Furthermore, a first container 260 from the series of containers 200 is in fluid communication with a fluid input line 301, and a last container 262 from the series of containers 200 is in fluid communication with a fluid output line 302. The first container 260 intakes gas to be heated through the fluid input line 301, and the last container 262 expels the heated gas through the fluid output line 302. The first container 260 is furthermore in thermal communication with a coolest portion 12 of the gradational heat transfer element 1, and the last container 262 is in thermal communication with a warmest portion 13 of the gradational heat transfer element 1. Thus, gas is transferred along the fluid flow path 304 into the first container 260, through any intermediary containers in the series of containers 200, into the last container 262, and is expelled out from the last container 262, having received incrementally increasing heat energy from the gradational heat transfer element 1 along the fluid flow path 304 through the series of containers 200.

In some embodiments, at least one of the series of containers 200 is positionally fixed along the gradational heat transfer element 1. In some embodiments, at least one of the series of containers 200 is isolated from the gradational heat transfer element 1. That is to say, it should be understood that in the present invention no container in the series of containers 200 or chamber of any of the series of containers 200 should necessarily be restricted to being positionally fixed, positionally variable, in contact or thermal communication with the gradational heat transfer element 1, or isolated from the gradational heat transfer element 1. Various embodiments of the present invention may utilize any combination of the aforementioned relations.

In some embodiments, the change in volume of the subsequent subvolume is at least the same as the change in volume of the arbitrary subvolume multiplied by the pressure in the arbitrary subvolume divided by the pressure in the subsequent subvolume.

In some embodiments, the gas volumes are constant in size. In some embodiments, the gas volumes may vary in size.

Some embodiments further comprise a fluid flow rectifier 303, with the arbitrary subvolume being connected to the subsequent subvolume through the fluid flow rectifier 303.

In a first preferred embodiment, gas is heated by being advanced serially through the series of containers 200, with each container being in thermal communication with a span of the gradational heat transfer element 1 of incrementally higher temperature than that of the previous container. Thus, heat energy is transferred to the gas through the walls of the containers.

In reference to FIG. 1, in some embodiments, each container in the series of containers 200 comprises at least one container fluid input line 263, at least one container fluid output line 264, and at least one chamber 210. An arbitrary chamber 230 from the at least one chamber 210 is in periodic fluid communication with a subsequent chamber 240 from the at least one chamber 210, wherein fluid is periodically and unidirectionally ejected from the arbitrary chamber 230 into the subsequent chamber 240, and wherein the sum of a volume of the arbitrary chamber 230 and a volume of the subsequent chamber 240 is constant. The at least one container fluid input line 263 is in unidirectional fluid communication with the at least one container fluid output line 264 through the at least one chamber 210 for each of the series of containers 200. The container fluid output line 264 of an arbitrary container 203 from the series of containers 200 is in fluid communication with the container fluid input line 263 of a subsequent container 204 from the series of containers 200, wherein the arbitrary container 203 precedes the subsequent container 204 in the series of containers 200.

Figure 3:
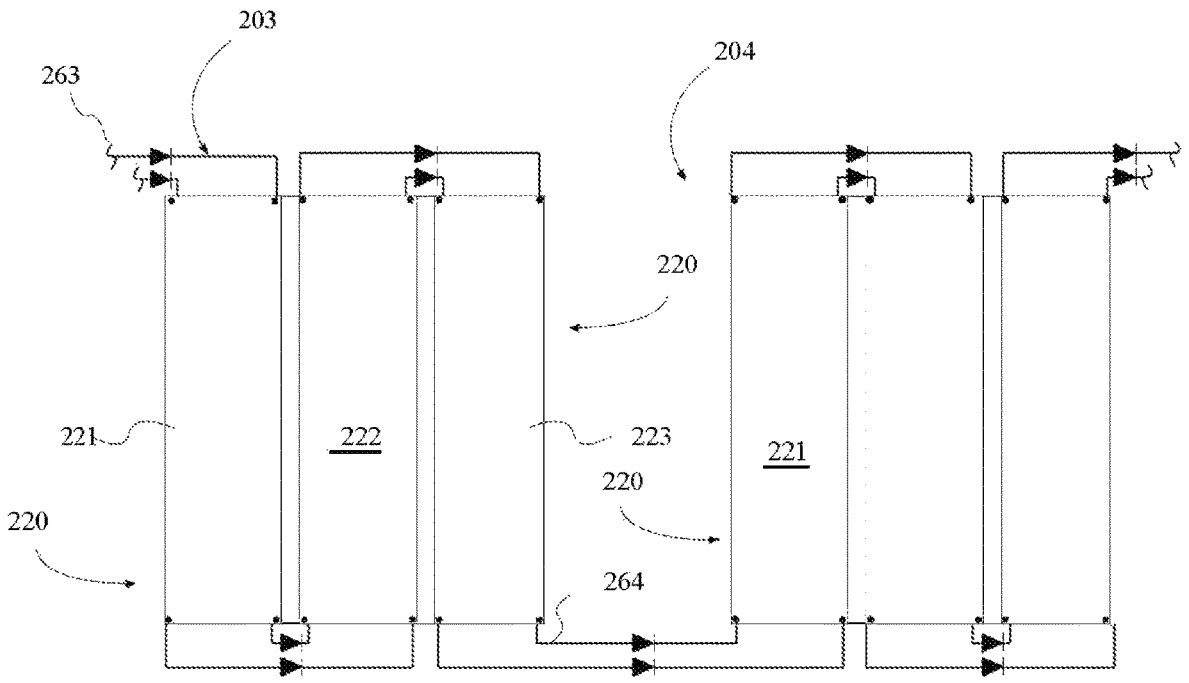
FIG. 3 is a diagram illustrating containers with more than two chambers.

In some embodiments, at least one of the series of containers 200 comprises a plurality of chambers 220. In some embodiments, each of the series of containers 200 comprises a plurality of chambers 220. As illustrated in FIG. 3, in some embodiments, the plurality of chambers 220 comprises an input chamber 221, at least one medial chamber 222, and an output chamber 223. The plurality of chambers 220 is in periodic unidirectional fluid flow serially from the input chamber 221, through each medial chamber 222, to the output chamber 223. The output chamber 223 of an arbitrary container 203 from the series of containers 200 is in fluid communication with the input chamber 221 of a subsequent container 204 from the series of containers 200, wherein the arbitrary container 203 precedes the subsequent container 204 in the series of containers 200. Thus, according to the preceding disclosure, gas is advanced through a plurality of chambers 220 within the arbitrary container 203 into the subsequent container 204, and may further be advanced through a plurality of chambers 220 within the subsequent container 204. As the gas is advanced through the chambers, the gas receives incrementally greater amounts of heat energy from the gradational heat transfer element 1.

In some embodiments, each of the series of containers 200 comprises a first subvolume 224 and a second subvolume 225, and the sum of a volume of the first subvolume 224 and a volume of the second subvolume 225 is constant. In some embodiments, the first subvolume 224 of an arbitrary container 203 from the series of containers 200 is in periodic unidirectional fluid communication with the second subvolume 225 of a subsequent container 204 from the series of containers 200, wherein the arbitrary container 203 precedes the subsequent container 204 in the series of containers 200. In some embodiments, the second subvolume 225 of the arbitrary container 203 is in periodic unidirectional fluid communication with the first subvolume 224 of the subsequent container 204, such that the sum of a volume of the second subvolume 225 of the arbitrary container 203 and a volume of the first subvolume 224 of the subsequent container 204 is constant. As such, in some embodiments, fluid is alternatingly directed from the first subvolume 224 of the arbitrary container 203 into the second subvolume 225 of the subsequent container 204 and from the second subvolume 225 of the arbitrary container 203 into the first subvolume 224 of the subsequent container 204. This may be accomplished through synchronous reciprocating motion of the moveable elements 250 of the arbitrary container 203 and the subsequent container 204. This process is illustrated in FIGS. 4-8.

In some embodiments, each of the series of containers 200 comprises an input subvolume 221 and an output subvolume 223, such that the sum of a volume of the input subvolume 221 and a volume of the output subvolume 223 is constant.

The input subvolume 221 of an arbitrary container 203 from the series of containers 200 is in periodic unidirectional fluid communication with the output subvolume 223 of the arbitrary container 203. The output subvolume 223 of the arbitrary container 203 is in period fluid communication with the input subvolume 221 of a subsequent container 204 from the series of containers 200, and the input subvolume 221 of the subsequent container 204 is in periodic unidirectional fluid communication with the output subvolume 223 of the subsequent container 204.

Figure 9:
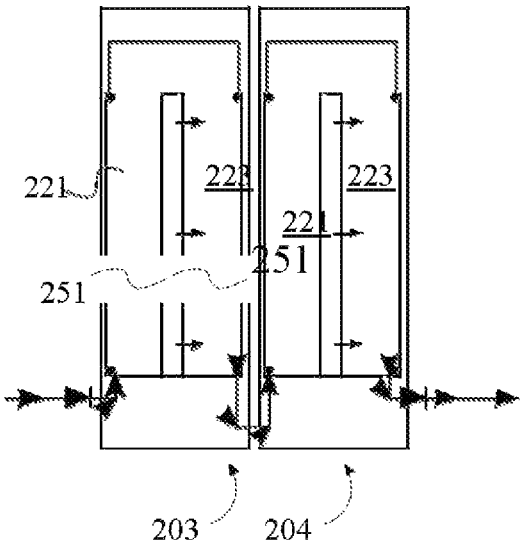
FIG. 9 is an illustration of one step of a second embodiment of the pumping process between containers.
Figure 10:
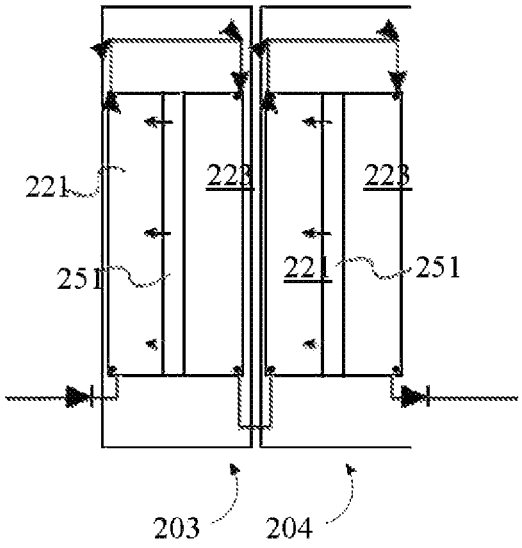
FIG. 10 is an illustration of another step of a second embodiment of the pumping process between containers.
Figure 11:
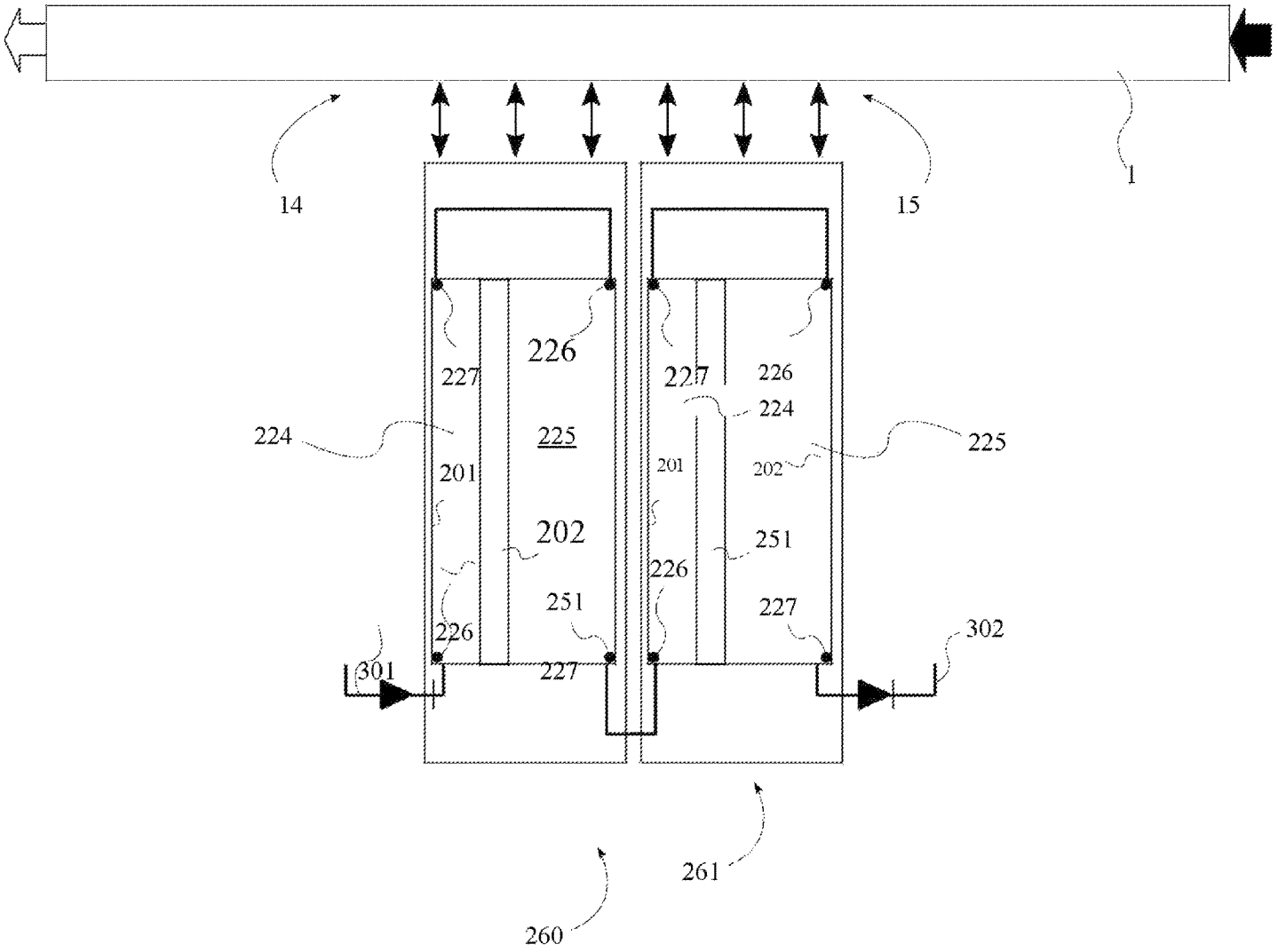
FIG. 11 is an illustration of a first container and a second container being in thermal communication with a cooler and a warmer segment of the gradational heating element.

Referring to FIGS. 9-10, in some embodiments, fluid is alternatingly directed from the output subvolume 225 of the arbitrary container 203 into the input subvolume 224 of the subsequent container 204 and from a preceding subvolume of the arbitrary container 203 into the output subvolume 225 of the arbitrary container 203.

In some embodiments, fluid is alternatingly directed from the output subvolume 225 of the arbitrary container 203 into the input subvolume 224 of the subsequent container 204 and from the input subvolume 224 of the subsequent container 204 into a subsequent subvolume 240 of the subsequent container 204.

In some embodiments, each of the series of containers 200 comprises a piston 251 as the moveable element 250, with the piston 251 being configured to translate reciprocatingly within the container for each of the series of containers 200. Furthermore, the piston 251 of an arbitrary container 203 from the series of containers 200 is constrained to move synchronously with the piston 251 of a subsequent container 204 from the series of containers 200, wherein fluid is directed from the arbitrary container 203 into the subsequent container 204 through synchronous movement of the piston 251 of the arbitrary container 203 and of the piston 251 of the subsequent container 204. The piston 251 may be sealed against the walls of the container such that the piston 251 separates a first chamber 230 and a second chamber 240 or an input subvolume 224 and an output subvolume 225 within the container, and gas is taken in and expelled out from the subvolumes through motion of the piston 251 acting to expand or contract the volume of the subvolumes.

Figure 4:
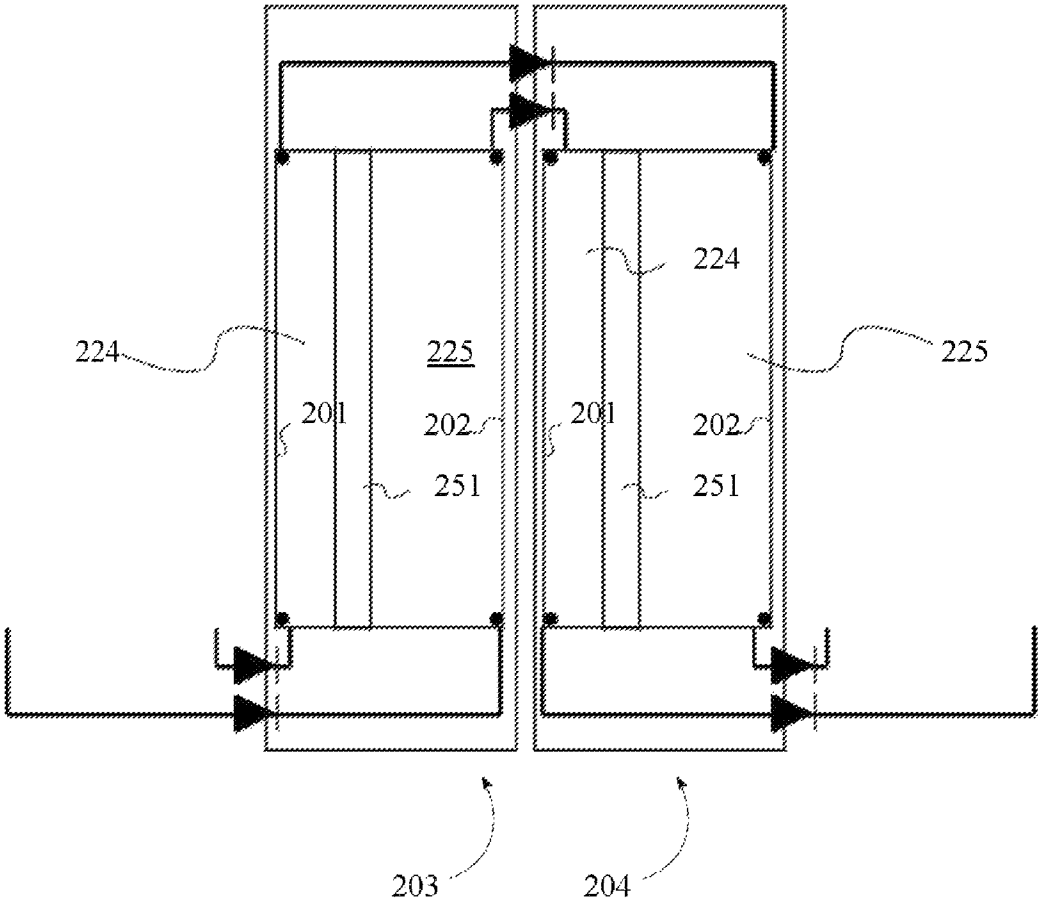
FIG. 4 is a diagram illustrating an arbitrary and a subsequent container.
Figure 5:
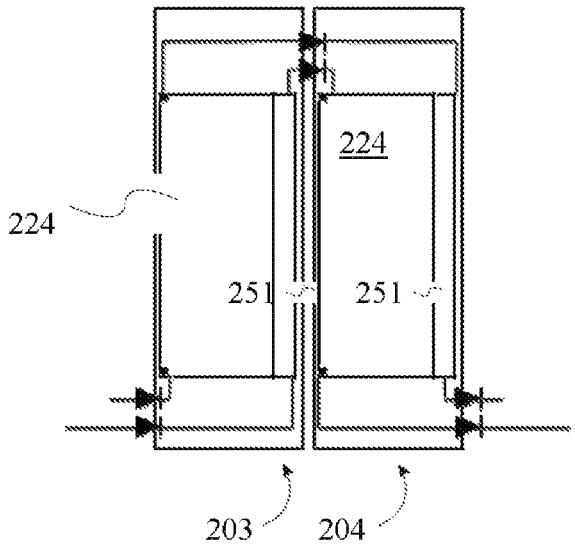
FIG. 5 is an illustration of a first step of one embodiment of the pumping process between containers.
Figure 6:
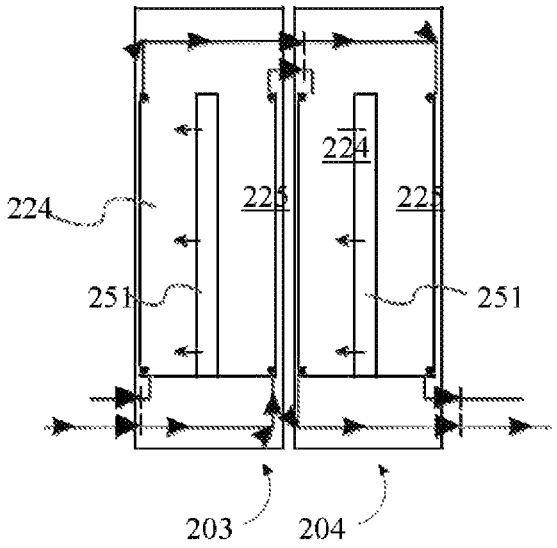
FIG. 6 is an illustration of a second step of one embodiment of the pumping process between containers.
Figure 7:
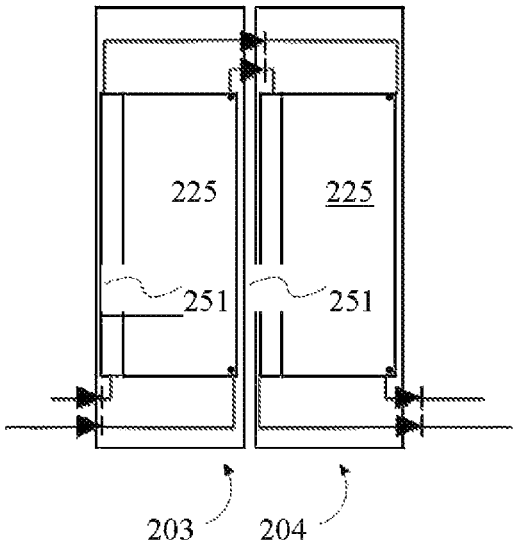
FIG. 7 is an illustration of a third step of one embodiment of the pumping process between containers.
Figure 8:
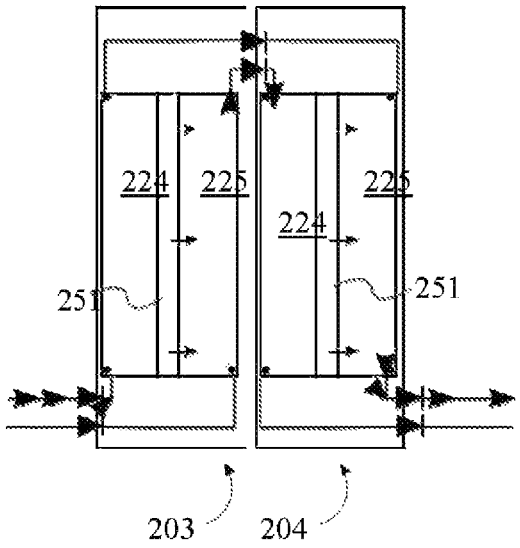
FIG. 8 is an illustration of a fourth step of one embodiment of the pumping process between containers.

Referring to FIG. 4, in some embodiments, each of the series of containers 200 comprises a first subvolume 224 and a second subvolume 225, wherein the first subvolume 224 and the second subvolume 225 are separated by the piston 251, and wherein a volume of the first subvolume 224 and a volume of the second subvolume 225 are inversely transformed through reciprocating motion of the piston 251 for each of the series of containers 200.

In a non-limiting example, in some embodiments, the piston 251 is essentially a moveable wall that translates within the container between a first side wall 201 and a second side wall 202 of the container, the first side wall 201 and the second side wall 202 being positioned opposite each other within the container. The first subvolume 224 defined by the volume of space within the container between the piston 251 and the first side wall 201, and the second subvolume 225 is defined by the volume space within the container between the piston 251 and the second side wall 202. As the piston 251 reciprocates within the container between the first side wall 201 and the second side wall 202, the volume of space occupied by the first subvolume 224 and the second subvolume 225 is inversely transformed. Assuming that the interior of the container is rectangular, the volumes of the first subvolume 224 and the second subvolume 225 are equal when the piston 251 is at a midway point between the first side wall 201 and the second side wall 202. When the piston 251 is positioned against the first side wall 201, the volume of the first subvolume 224 is zero. Similarly, when the piston 251 is positioned against the second side wall 202, the volume of the second subvolume 225 is zero. Thus, the movement of the piston 251 within the container inversely transforms the volumes of the first and second subvolume 225 such that the sum of the volumes of the first and second subvolumes is constant. It should be noted however that other arrangements of components may be utilized to accomplish a similar purpose. For example, in some embodiments the walls of the container may be flexible, able to expand and contract with the changing pressure within the chambers as the moveable element 250 moves within the container.

The pistons of consecutive containers in the series of containers 200 are constrained to move synchronously within the containers, and thus perform a reciprocating pumping cycle. The chambers within the containers each have at least one input and at least one output, and the movement of the piston 251 within the containers functions to draw gas into the chambers through the inputs and expel gas from the chambers through the outputs, similar to the functionality of a syringe.

In an exemplary, non-limiting embodiment, the series of containers 200 comprises a first container 260 and a second container 261. The first container 260 is in thermal communication with a cooler segment 14 of the gradational heating element, and the second container 261 is in thermal communication with a warmer segment 15 of the gradational heating element. A fluid input line 301 is connected to the input 226 of the first subvolume 224 of the first container 260, wherein gas coming from the fluid input line 301 is cooler than the cooler segment 14 of the gradational heating element and is to be warmed by advancing the gas through the first container 260 and second container 261. The output 227 of the first subvolume 224 of the first container 260 is connected to the input 226 of the second subvolume 225 of the first container 260. The output 227 of the second subvolume 225 of the first container 260 is connected to the input 226 of the first subvolume 224 of the second container 261. The output 227 of the first subvolume 224 of the second container 261 is connected to the input 226 of the second subvolume 225 of the second container 261. The output 227 of the second subvolume 225 of the second container 261 is connected to a fluid output line 302.

Starting at the first side wall 201, the piston 251 of both the first container 260 and the second container 261 each move toward the respective second side wall 202 within the first container 260 and second container 261. Let this action be known as a first stroke of the cycle. This action simultaneously: (1) intakes cold gas from the fluid input line 301 into the first subvolume 224 of the first container 260; (2) outputs gas from the second subvolume 225 of the first container 260 into the first subvolume 224 of the second container 261; and (3) outputs gas from the second subvolume 225 of the second container 261 through the fluid output line 302.

After the piston 251 is moved all the way to the second side wall 202, the piston 251 begins to travel back toward the first side wall 201—a second stroke of the cycle. This action simultaneously: (1) outputs gas from the first subvolume 224 of the first container 260 into the second subvolume 225 of the first container 260; and (2) outputs gas from the first subvolume 224 of the second container 261 into the second subvolume 225 of the second container 261.

In the previous exemplary description, the nature of the connections between the chambers and containers results in heated gas being expelled from the fluid output line 302 only on the first stroke of the cycle, with the second stroke re-filling the output chambers in preparation for the next first stroke. It is contemplated, of course, that various other arrangements of connections between chambers and containers may result in other conditions, such as gas being expelled from the fluid output line 302 on every stroke as opposed to every other stroke.

Figure 12:
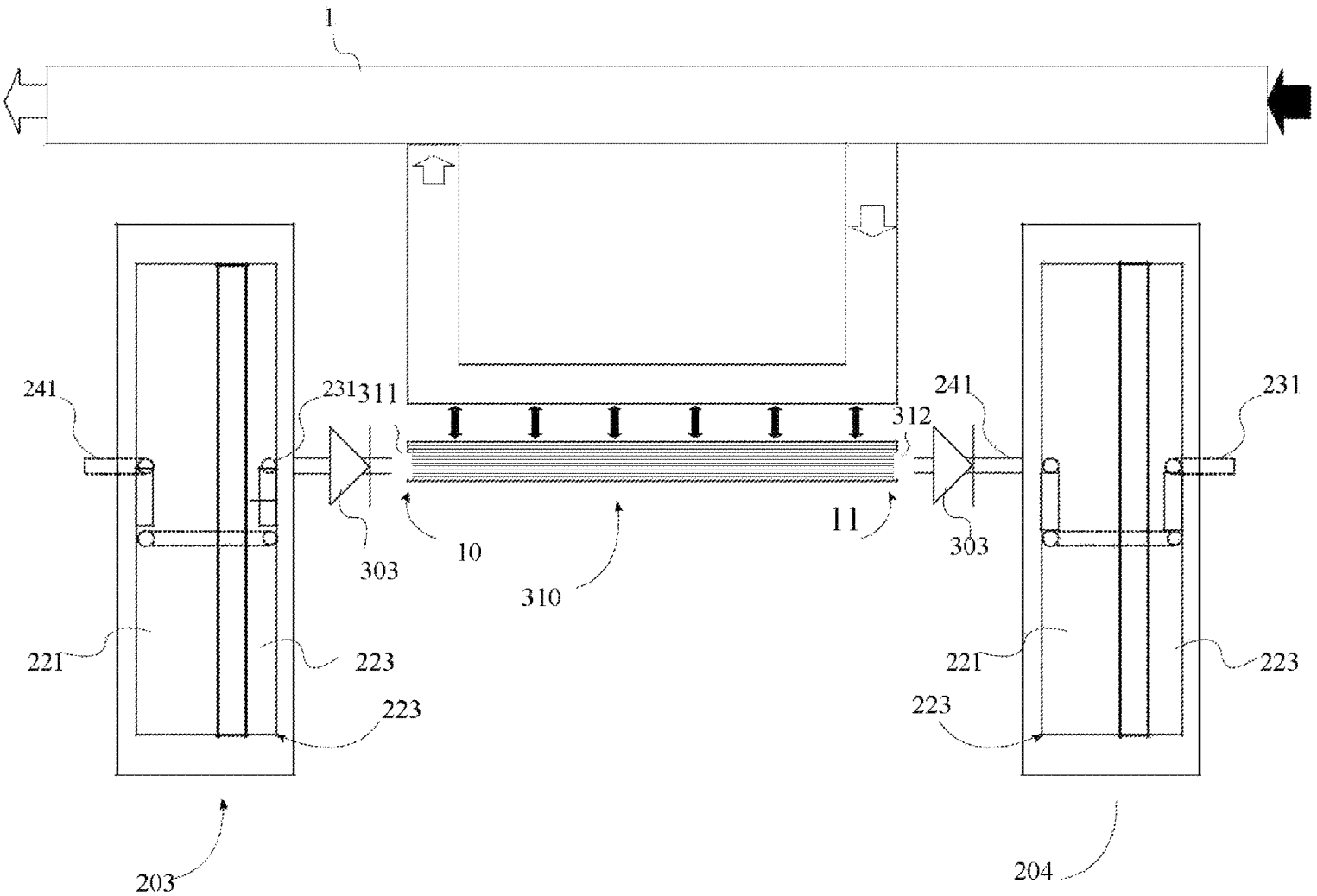
FIG. 12 is a diagram of a second embodiment of the heating section.

Referring to FIG. 12, in a second preferred embodiment of the gas heating unit, the arbitrary container 203 is in periodic fluid communication with the subsequent container 204 through a heat exchanger 310, and the heat exchanger 310 is in thermal communication with a span of the gradational heat transfer element 1. In some embodiments comprising a fluid flow rectifier 303, the arbitrary subvolume is connected to the subsequent subvolume through the fluid flow rectifier 303. In this second preferred embodiment, the heating occurs via transfer through a heat exchanger 310 external to the containers, as opposed to within the containers themselves as in the first preferred embodiment.

In some embodiments, fluid is sequentially directed from the input subvolume 224 of the arbitrary container 203, to the output subvolume 225 of the arbitrary container 203, through the heat exchanger 310, to the input subvolume 224 of the subsequent container 204, and to the output subvolume 225 of the subsequent container 204.

As a general summary, the second preferred embodiment may comprise: at least one sealed, pumpable, cold gas container, used to intake and expel cold gas, comprising at least one inlet 241 and at least one outlet 231; at least one sealed, pumpable, warm gas container, used to intake and expel warm gas, comprising at least one inlet 241 and at least one outlet 231; a heat exchanger 310 having a large size relative to the said containers, for heating up incoming gas as well as preventing the cold and hot gas from being mixed, while also allowing for pressure equalization throughout the whole flow of said heat exchanger 310, and also keeping even pressure with the containers when connected to them. The cold end 10 of the heat exchanger 310 is periodically, fluidly connected to the cold gas container, and the warm end of the heat exchanger 310 is periodically, fluidly connected to the warm gas container. The gas in the cold container is first pressure equalized with the heat exchanger 310 and the warm gas container, whereafter equal volume is moved into the heat exchanger 310's cold input from the cold gas container as the volume to be ejected into the warm gas container from the hot end 11 of the heat exchanger 310. Furthermore, components in said containers do not move outside the container unless said components are so insulated that different temperature influences on them are negligible.

In some embodiments, the pressure equalization is achieved by the gas from the heat exchanger 310's cold end 10 being ejected back into the cold gas container 203 to equalize the pressure. In some embodiments, the pressure equalization is achieved by gas from the heat exchanger 310's hot end 11 being released into the hot gas container 204 while the connection between the cold gas container 203 and the heat exchanger 310 is closed. Simultaneously, enlargement of the hot gas container 204 is by some means undisclosed herein physically connected to the compression of the cold gas container 203, so that when the hot gas container 204 expands, the cold gas container 203 contracts with the same volume until the two containers achieve the same pressure. Equal volume is moved into the heat exchanger 310's cold end 10 from the cold gas container 203 as the volume to be moved into the warm container 204 from the heat exchanger 310's hot end 11.

As in the first preferred embodiment, the second preferred embodiment also involves at minimum an arbitrary container 203 and a subsequent container 204 from the series of containers 200. In some embodiments, an output subvolume 225 of the arbitrary container 203 is in fluid communication with a cooler end 10 of a heat exchanger 310, and a warmer end 11 of the heat exchanger 310 is in fluid communication with an input subvolume 224 of the subsequent container 204. Furthermore, the heat exchanger 310 is in thermal communication with a span of the gradational heat transfer element 1. In some embodiments, the heat exchanger 310 and the gradational heat transfer element 1 are one and the same. In some embodiments, particularly in embodiments with a chain of several containers each separated by a heat exchanger 310, each subsequent heat exchanger 310 may be in thermal communication with warmer and warmer spans of the gradational heat transfer element 1. For example, a primary gradational heat transfer element 1 may have a series of branching lines, each drawing higher temperatures from the gradational heat transfer element 1 to operate a corresponding heat exchanger 310. Alternatively, the gradational heat transfer element 1 may be understood to be the collection of individual heat exchanger between the containers.

Furthermore, the heat exchanger 310 is configured to prevent cold gas from mixing with hot gas within the heat exchanger 310. The heat exchanger 310 is connected between an outlet 231 of the arbitrary container 203 and an inlet 241 of the subsequent container 204. Preferably, the heat exchanger 310 has significantly larger volume than the arbitrary container 203 and the subsequent container 204. Furthermore, an input connection 311 and an output connection 312 of the heat exchanger 310 are openable, wherein pressure equalization between the arbitrary container 203, the heat exchanger 310, and the subsequent container 203 is achieved before gas movement is performed, and wherein the volume moved into the cold end 10 of the heat exchanger 310 from the arbitrary container 203 is equivalent to the volume being moved out from the hot end 11 of the heat exchanger 310 to the subsequent container 204 when gas movement is performed.

Some embodiments further comprise an openable cold connection 311 between the cold end 10 of the heat exchanger 310 and the arbitrary container 203, wherein the pressure equalization is achieved through a portion of gas being ejected from the cold end of the heat exchanger 310 into the arbitrary container 203 through the openable cold connection 311.

Alternatively or additionally, some embodiments further comprise an openable hot connection 312 between the hot end 11 of the heat exchanger 310 and the subsequent container 204, wherein the pressure equalization is achieved through a portion of gas being ejected from the hot end 11 of the heat exchanger 310 into the subsequent container through the openable hot connection 312.

In some embodiments, the heat exchanger 310 is configured to prevent cold gas from mixing with hot gas through a plurality of narrow passages between the cold end 10 and the hot end 11 of the heat exchanger 310. Having the plurality of narrow passages reduces the amount of lateral movement gas is afforded, thus resisting backpressure of the hot gas to cooler regions.

Figure 13:
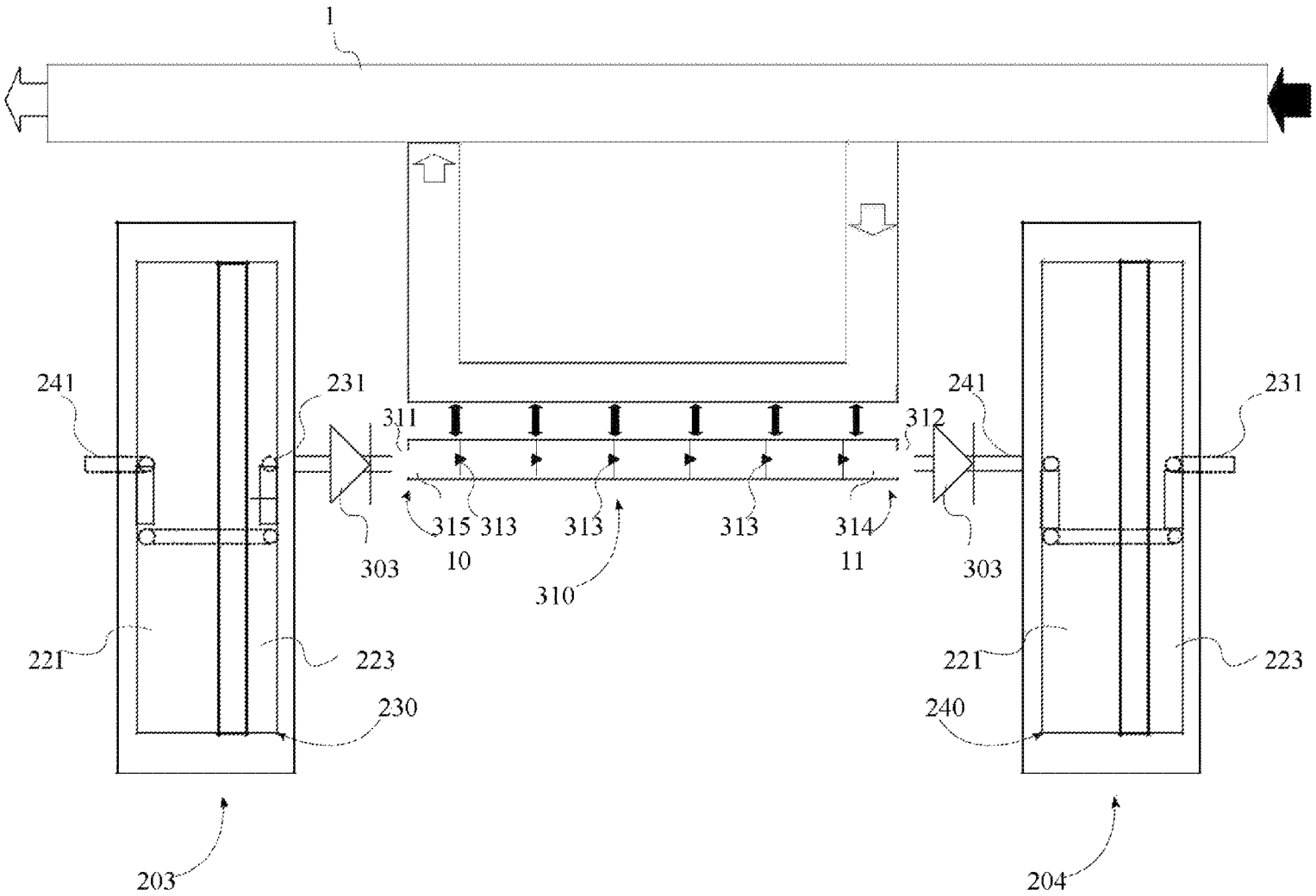
FIG. 13 is an alternate diagram of the second embodiment of the heating section.
Figure 14:
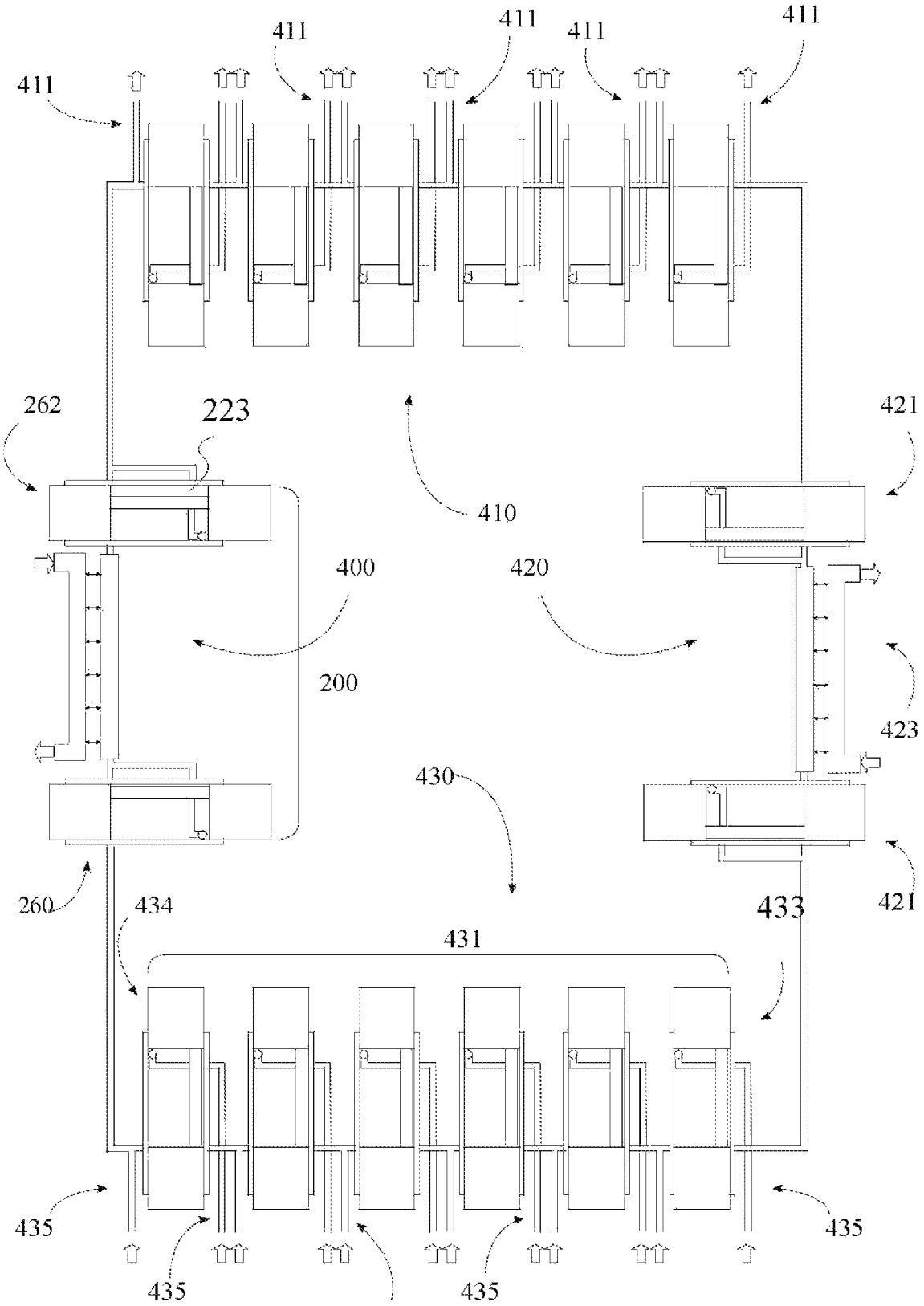
FIG. 14 is a diagram of a cyclical system utilizing the present invention.

In some embodiments, the heat exchanger 310 is configured to prevent cold gas from mixing with hot gas through a series of heat exchanger 310 chambers, as can be seen in FIG. 13, wherein the series of heat exchanger 310 chambers increases incrementally in temperature, wherein the series of heat exchanger 310 chambers are separated by openable heat exchanger connections 313, and wherein the openable heat exchanger connections 313 are configured to be opened in sequential order from an output heat exchanger chamber 314 of the series of heat exchanger 310 chambers to an input heat exchanger chamber 315 of the series of heat exchanger chambers.

Furthermore, in some embodiments the gas volume is restricted from moving from the cold end 10 of the heat exchanger to the arbitrary container 203, wherein the subsequent chamber 240 has a smaller volume than the arbitrary chamber 230. This may be accomplished through any appropriate means. In some embodiments, the gas volume is restricted from moving from the cold end 10 of the heat exchanger 310 backward into the arbitrary container 203 through a one-way valve from the arbitrary container 203 to the heat exchanger 310.

A system embodiment of the present invention can be summarized as comprising a heating section 400, an output section 410, a cooling section 420, and an input section 430. These aforementioned of the system may be connected together in series, forming a cycle. The previous descriptions of the first preferred embodiment and the second preferred embodiment have in general been describing the heating section 400 of the system. It may be understood that in some embodiments the cooling section 420 may closely resemble the heating section 400, simply in reverse, i.e. advancing gas through multiple containers in order to cool gas as opposed to heating gas.

The series of containers 200 comprises a last container 262 from the series of containers 200. Furthermore, some embodiments comprise a gas ejection apparatus. The gas ejection apparatus may be understood to be the output section 410 of the system of the present invention in some embodiments. In some embodiments, the gas ejection apparatus comprises a series of destination volumes, wherein the series of destination volumes decrements in pressure from a first destination volume to a last destination volume. The last container 262 in the series of containers 200 of the heating section 400 is configured to eject a gas volume into the first destination volume of the gas ejection apparatus. The series of destination volumes is configured to transfer the gas volume from the first destination volume through the series of destination volumes to the last destination volume. The gas ejection apparatus serves to eject the gas that has been warmed by being advanced through the series of containers 200 and is ready for whatever application the gas was warmed in order to perform. The destination volumes may be other containers, or simply pipes for transferal to the gas's eventual destination, temporary storage volumes, external volumes, or any other volume for receiving the output heated gas.

The reason for the inclusion of gas ejection apparatus is that once the gas has been heated by being advanced through the series of containers 200, the gas will have a high pressure due to the temperature increase. In cases where the heated gas will be ejected into a flow with high pressure, but lower pressure than the heated gas, only a small amount of gas will be ejected, because gas is only ejected until the source and destination have the same pressure in order to avoid compression and thus efficiency losses. Thus, the heated gas is ejected into a destination with slightly lower pressure and temperature, and into a subsequent destination with even lower pressure and temperature, and so on, eventually ending with much lower pressure and temperature. Furthermore, in some embodiments the input section 430 may closely resemble the gas ejection apparatus, but configured to intake cold gas into the system as opposed to expelling hot gas from the system.

In some embodiments, the gas ejection apparatus comprises an array of outputs 411, wherein the gas ejection apparatus is connected to the output chamber 223 of the subsequent container 204 (or last container 262), and wherein the gas ejection apparatus is configured such that the output chamber 223 of the subsequent container 204 (or last container 262) is connected to outputs of decreasing pressure according to the change of pressure of the output chamber 223 of the arbitrary container 203.

In some embodiments, the gas ejection apparatus does not fully discharge all of the gas volume into the destination volumes, and an excess gas volume remains in the system. This excess gas volume can be circulated through the system back to the input section 430 for re-use in the pumping cycle.

Therefore, some embodiments further comprise a gas cooling apparatus (cooling section 420) comprising a cooling input 421, a cooling output 422, and a cooling element 423. The gas cooling apparatus exists in some embodiments of the system in order to use energy extracted from the cooled gas for other purposes, such as taking part in helping to heat the gas in the heating section 400 of the system. Thus, the system achieves higher efficiency by re-using any excess energy from the cooled gas. The last destination volume of the gas ejection apparatus is configured to transfer the excess gas volume into the cooling input 421 of the gas cooling apparatus. The gas cooling apparatus is furthermore configured to transfer the excess gas volume from the cooling input 421 to the cooling output 422 across the cooling element 423. As previously mentioned, in some embodiments the gas cooling apparatus resembles a temperature-reversed version of the first preferred embodiment or the second preferred embodiment of the heating section 400, advancing the excess gas volume through numerous containers and/or chambers, each in thermal communication with progressively cooler portions of the cooling element.

Some embodiments further comprise a gas injection apparatus (input section 430) comprising a series of input volumes 431, wherein the series of input volumes 431 increases in pressure from a first input volume 433 to a last input volume 434. The series of input volumes 431 is configured to transfer the excess gas volume from the first input volume 433 through the series of input volumes 431 to the last input volume 434, and the last input volume 434 is configured to inject the excess gas volume into a first container 260 from the series of containers 200. In some embodiments, the gas injection apparatus is configured similarly to the gas ejection apparatus. The gas injection apparatus may further be configured to receive new gas and inject the new gas into the system to be heated by the heating section 400 in addition to the recycled excess gas volume. Each of the input volumes 431 may have a gas input line 435, each receiving gas input from incrementally increasingly pressurized gas sources according to the increase in pressure of the series of input volumes 431.

Figure 15:
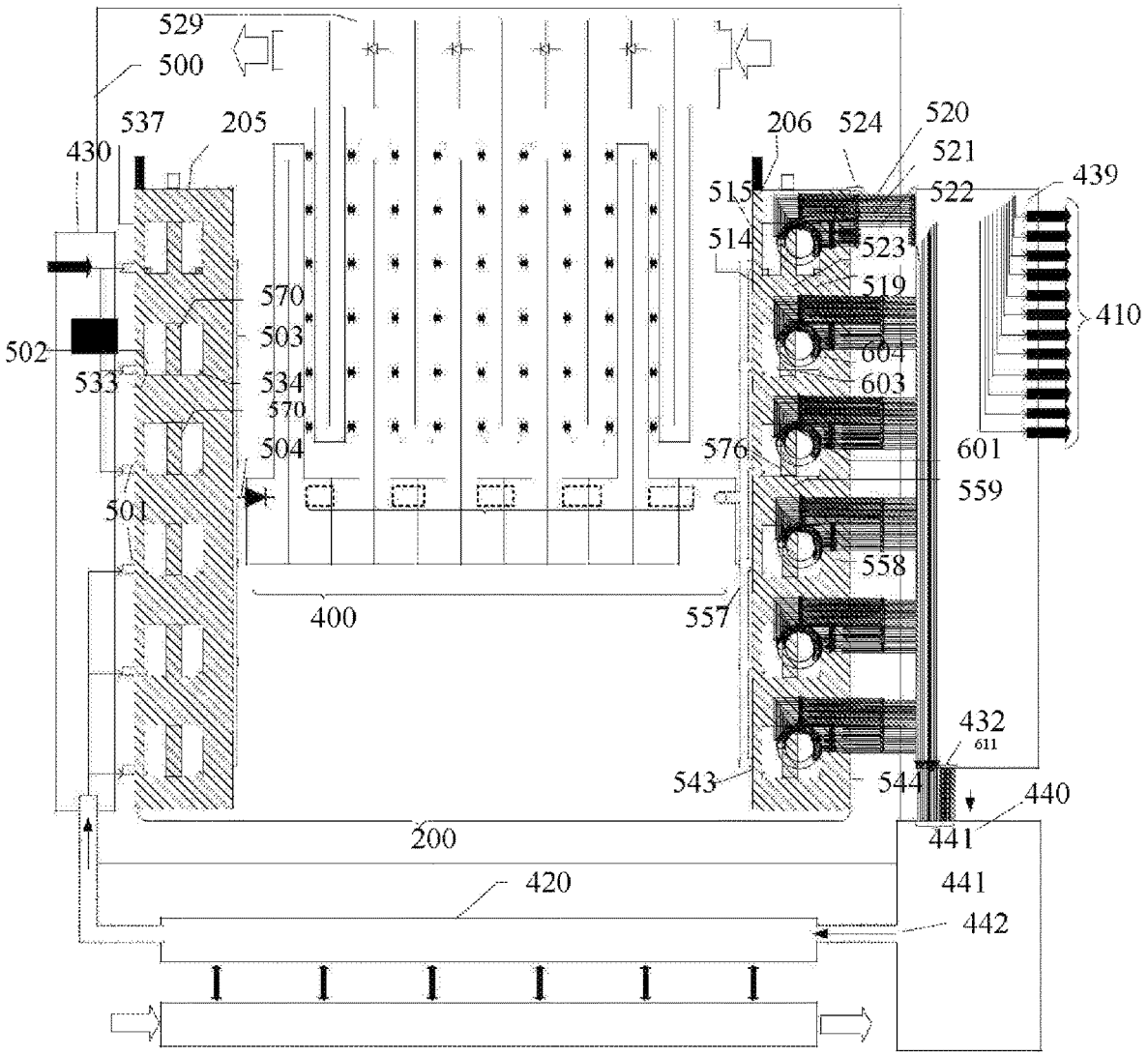
FIG. 15 is an alternate diagram of a cyclical system utilizing the present invention.

Referring to FIG. 15, some embodiments further comprise a transfer volume 440, wherein the transfer volume 440 comprises a transfer input 441 and a transfer outlet 442 for receiving and transmitting from other parts of the present invention. The gas injection apparatus, comprising an array of gas inputs 432 may be connected to the transfer volume 440. The gas injection apparatus is configured such that the transfer volume 440 is connected to inputs of increasing pressure while being disconnected from other parts of the present invention. The transfer volume 440 is further configured to inject the gas volume into the first container 260. In FIG. 15, 612 represents the input to the entire system. Furthermore, 529 refers to the counter-flow flow. 611 represents outputs not being used, since the unused outputs 611 would have to be high pressure to be recycled. Furthermore, there should be similar outputs adjacent to the external outputs 410.

Figure 16:
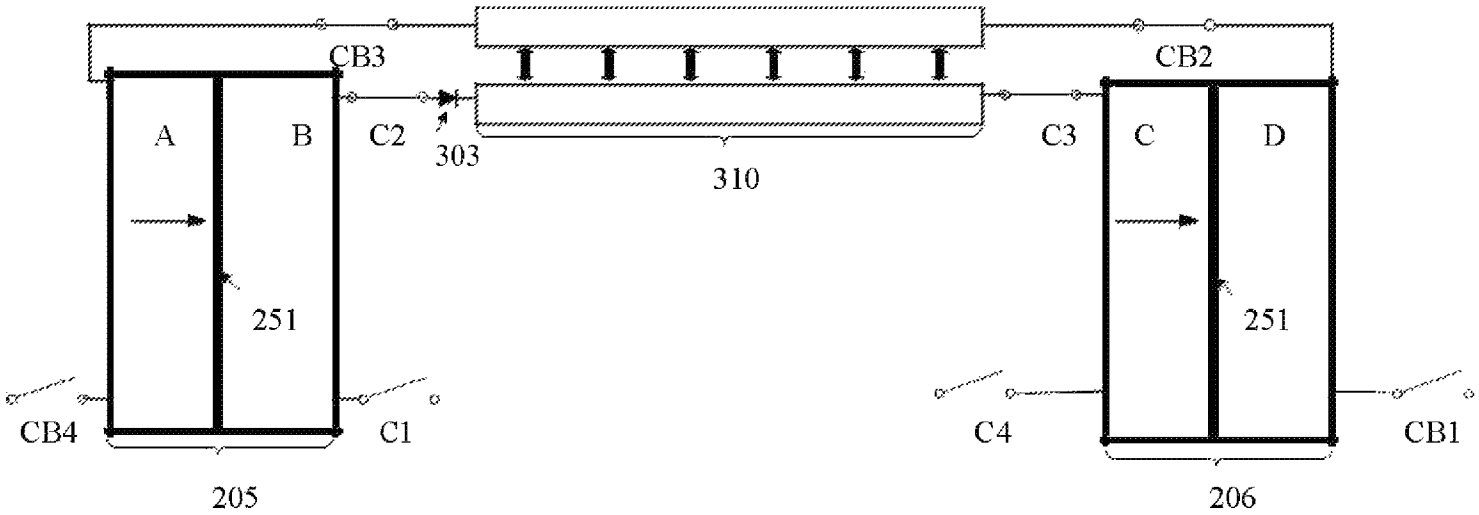
FIG. 16 is an alternate diagram of a cyclical gas recycling system without a cooling section utilizing the present invention with a first set of connections open.
Figure 17:
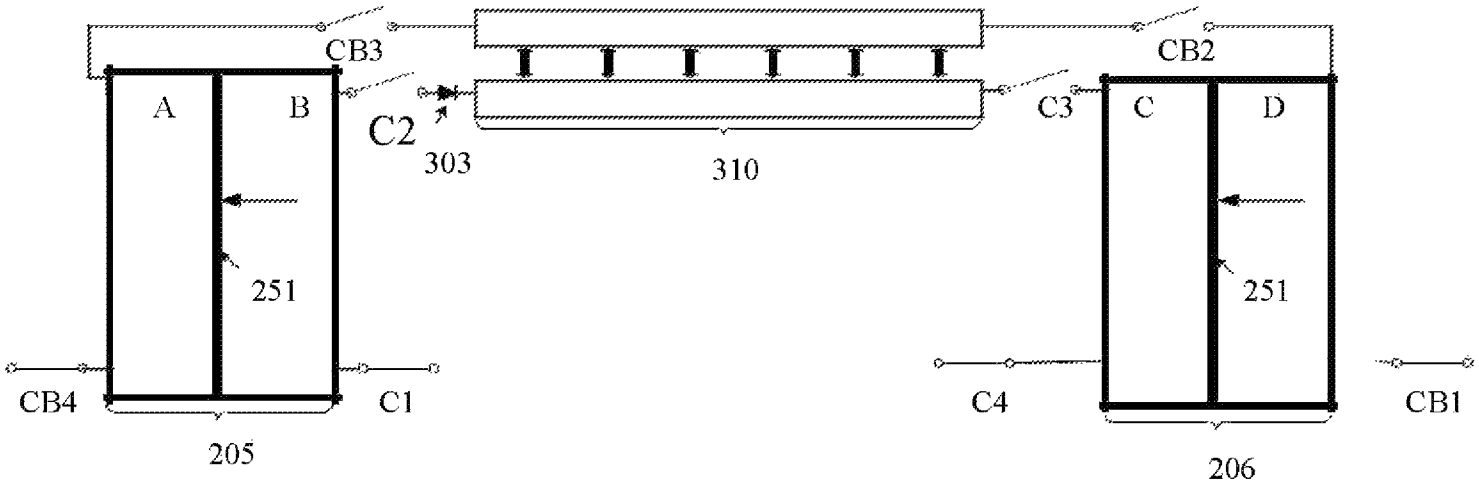
FIG. 17 is an alternate diagram of the cyclical gas recycling system without a cooling section utilizing the present invention with a second set of connections open.
Figure 18:
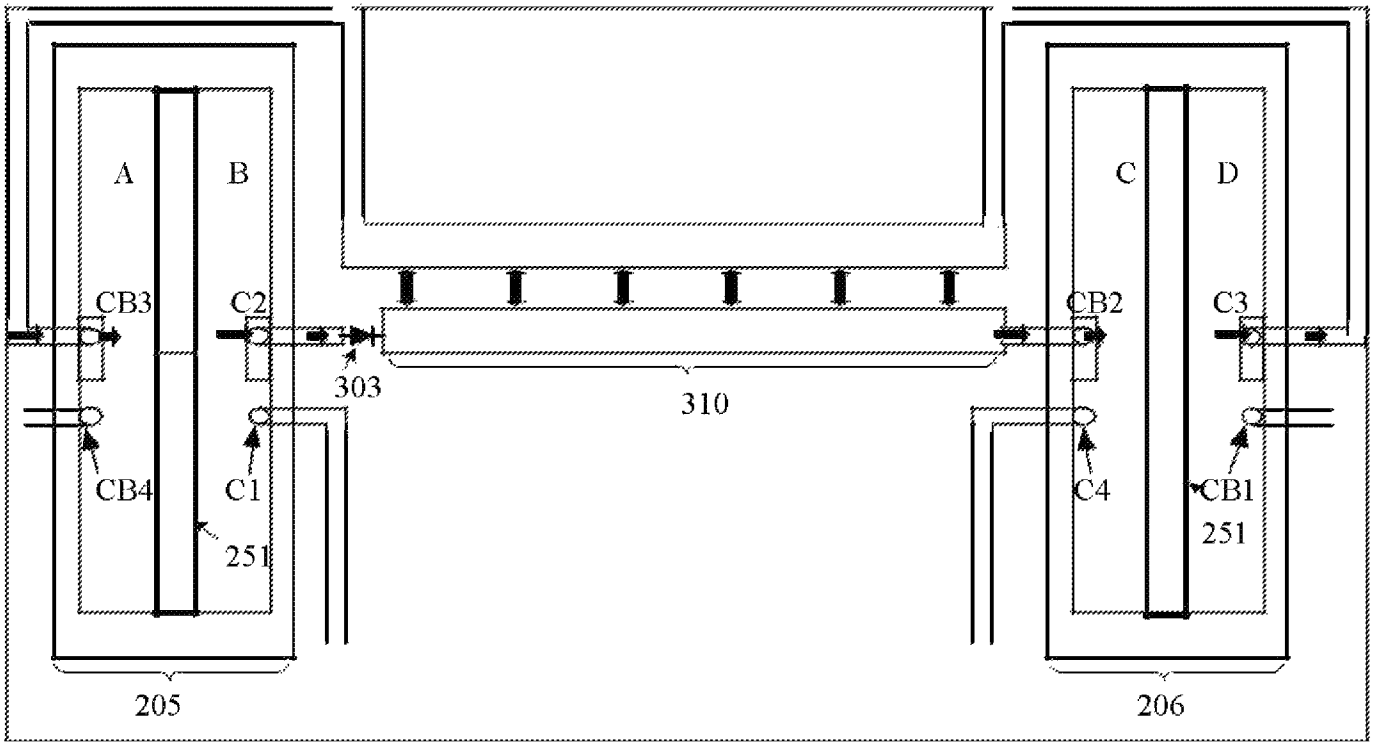
FIG. 18 is another alternate diagram of a cyclical gas recycling system without a cooling section utilizing the present invention.

In some embodiments, the cooling section 420 is not needed. Referring to FIGS. 16-18, assuming an input container 205 with chambers A and B, and an output container 206 with chambers C and D, the input 205 and output container 206 connected by a heat exchanger 310, the heat exchanger 310 being designed according to earlier descriptions to prevent cold and hot gas from mixing, to enable unidirectional flow, being of a large size, and with connections as shown in FIGS. 16-18. When chamber C is filled to the maximum, connections C2, C3, CB2 and CB3 are closed, while C1, CB4, C4 and CB1 are opened, such that high pressure gas comes in from CB1, pressing out the gas in chamber C into a slightly less pressurized flow via C4. This is done while the two pistons 251, connected to move synchronously, force B to expand, letting cold gas into B while letting out colder polluted gas into another flow. Subsequently, CB1 is closed and CB2 and CB3 are open while CB1, CB4, C4 and C1 are closed. In other words, A and D are connected and have the same pressure, so they don't oppose any movement from B to C. C2 and C3 open at the same time, as described in other sections. This cycle can easily be accomplished with the scroll pumping mechanism disclosed herein.

The following is a disclosure of one exemplary preferred embodiment, and should be understood to not be limiting to the scope of the present invention, rather to be illustrative of the spirit of the present invention.

The preferred embodiment can be summarized as comprising a heating section 400, an output section 410, a cooling section 420 and an input section 430. In some circumstances only the heating section 400 is relevant. In such cases, the present invention comprises: a heat exchanger 310 comprising a unidirectional flow from cold to hot, and a unidirectional counter flow from hot to cold; one input container 205 further comprising an input subvolume 224 and an output subvolume 225, wherein the output subvolume 225 is connected to the cold end 10 of the heat exchanger 310; one output container 206 further comprising an input subvolume 224 and an output subvolume 225, wherein the input subvolume 224 of the output container 206 is connected to the hot end 11 of the heat exchanger 310. The input subvolume 224 and output subvolume 225 in each container are configured such that the combined volume of the input and output chambers, designated as the container volume of the container, is constant. Nevertheless, all of said subvolumes may vary periodically from a minimum of zero to a maximum equivalent of the container volume.

Gas output by the input container 205 is transferred via a rectifier into the cold end 10 of the heat exchanger 310's warmed flow, whereby the output gas is further propagated through the heat exchanger 310's warmed flow in a unidirectional manner.

The output container 206 is separated into several sub chambers, all sub chambers being parallel coupled with their input connected to the output of the heat exchanger 310. Each sub volume is further separated by a piston 251, all pistons being connected in such a manner that all piston move in sync.

The chambers of the input container 205 are only separated by one piston 251, sealingly separating the input chamber 221 and the output chamber 223. The piston 251 moves reciprocatingly in said input container 205, thereby changing the volume of the comprised input and output chambers, still having the total volume of the input chamber 221 and the output chamber 223 of the input container 205 constant.

The same setting applies for the output container 206, even though the chambers of the output container 206 are further separated into several sub-chambers with a total volume equal to said container volume. In other words, each of said sub-chamber is separated into a sub-input-chamber and a sub-output-chamber by a piston 251, wherein each sub chamber is constant in volume even though their comprising sub-input-chamber and a sub-output-chamber is varied periodically by the piston 251.

The pistons 251 in the input and output container are attached to one another so they move synchronously. When gas is moved into the input chambers 221 of the output container 206, their total volume is increased by the same amount as the output chamber 223 of the input container 205 is decreased at the same time. However, this does not mean that the same amount of gas is moved in the containers at all times. Since the heat exchanger 310 is subsided by a rectifier, gas is only ejected by it when it achieves the same pressure as the heat exchanger 310.

In the heat exchanger 310 the gas, in the warmed flow, is running in a flow going from cold to hot. The gas is gradually passing by hotter and hotter walls as it would be in a regular counter flow heat exchanger 310. The gas is separated into different temperature zones, to prevent cold gas from mixing with hot gas and to promote unidirectional flow. The zones are separated by walls but are periodically connected by a number of passages, coupling each temperature zone only to a temperature zone closest in temperature, the closest warmer zone and closest colder zone. The passages open sequentially in a predefined order, starting from the hottest part, sequentially moving down to the coldest end of the heat exchanger 310, in descending ordered by the zone temperature. The coldest temperature zone have both said rectifier as an input and a passage according to above as an input, to assure that if for some reason the pressure in the output chamber 223 of the input container 205 would become higher than the heat exchanger 310's pressure, before the passage opens, gas will be ejected into the heat exchanger 310. Within each temperature zone, the gas can hypothetically move up and down the temperature span but it is suggested to keep the temperature spans within each temperature zone small so that the pressure difference due to temperature difference is negligible, even though pressure is even in an open flow. Furthermore, for gas in the same temperature zone and same temperature, the gas is further separated, in that it runs in many narrow parallel channels. This is to prevent circulation within the temperature zone and therefore further prevent cold and hot gas from mixing. If the gas moves backwards it hopefully moves backwards pressing the cold gas backwards without mixing with it, since inductive cooling is unwanted. There should be a large number of channels to keep the friction to a minimum.

Furthermore, the heat exchanger 310 should have a significantly larger volume than the containers, in a sense that the pressure changed by an added container volume is negligible.

When a volume of gas enters the cold end 10 of the heat exchanger 310 it will be of high density. The hot gas with high pressure exiting from the hot end 11 of the heat exchanger 310 will have pushed the piston 251 forward in the output container 206, and therefore forced the piston 251 of the input container 205 to compress the gas in the output subvolume 225 of the input container 205.

Since the aim is to maintain a substantially even pressure, due to periodical pressure equalization, throughout the heat exchanger 310, the high-pressure gas exiting from the hot end 11 of the heat exchanger 310 will have substantially the same pressure as the heat exchanger 310. Therefore, the gas in the output subvolume 225 will be compressed until it reaches the same pressure as the heat exchanger 310.

When the high dense gas enters a hotter region, its pressure will become even higher and will try to expand, forcing the hotter gas to move to hotter regions—for example, when the pistons 251 in the input container 205 and output container 206 are at their leftmost position and start moving right, gas will enter the input subvolume 224 of the output container 206. This will be further provoked by the fact that the output of the heat exchanger 310 will open first, slightly dropping that pressure so that when the passage opens from the next hottest temperature zone, the destination will more likely have a lower pressure. The same is true for all the adjacent temperature zones, in that the hotter ejects gas first and therefore likely have lower pressure than the slightly colder temperature zone that connects to said hotter adjacent temperature zone shortly afterward.

This behavior of the input passages sequentially opening, in descending order by temperatures of the temperature-zones is, in this embodiment, accomplished by an element comprising said passages, designated passage-element, mechanically connected to the piston 251 of the containers and therefore undergoes the same reciprocating movement as the piston 251. The different passages are placed on said passage-element so that when the passage-element comes to a certain position two adjacent zones will become connected. The passages between hotter zones are longer than the passages between colder zones and therefore will open earlier, during the piston 251's movement to the right. This holds true for all passages. All passages stay open till the end of the piston 251's movement forward. The passage between the input container 205 and the heat exchanger 310 should optimally open exactly when the input container 205 reaches the same pressure as the heat exchanger 310. Since this is difficult to accomplish the container and the heat exchanger 310 are connected via a rectifier.

As discussed, the output container 206, is separated into several horizontal sub-chambers with a total volume equal to said container volume. Each of the sub-chambers of the output container 206 has an inlet constantly connected in parallel to the output of the heat exchanger 310. The reason for implementing the numerous sub-chambers is that when the apparatus is used for large temperature increases, the initial pressure differences between the output chamber 223 of the input container 205 and the input subvolumes 224 of the output container 206 will be large. When the input subvolume 224 of the output container 206 start pressing the piston 251 to make them compress the gas in the output subvolume 225 of the input container 205, they will start doing that with excessive force, which will lead to losses. If, on the other hand, the starting surface will be smaller, and subsequently increase successively along with the increasing pressure in the output subvolume 225 of the input container 205, the losses will decrease. In this embodiment, this is accomplished by only using a few of the sub-volumes in the beginning of the movement, the rest having their two sides of the piston 251 connected so that no extra gas will enter. Then, at predefined positions in the piston 251 span, those connections will be passed and instead, connections will quickly open towards destinations of decreasing pressure. After these connections are passed, the pressure in the output subvolume 225 of the output container 206 of an arbitrary sub-chamber will be at its minimum level, and the piston 251 in said arbitrary sub-chamber will add full force to the compression of the gas in the output subvolume 225 of the input container 205. In this way, more and more force can be added during the piston 251 movement. When the pressure of the output subvolume 225 of the input container 205 and the heat exchanger 310 are equal, all sub-chambers will participate in moving gas.

The connections that the sub-chambers pass by can be connected to different positions via an undisclosed connections device, making the embodiment dynamic and adjustable for different temperature changes. However, it is not likely that these connection changes will occur during the piston 251 movement.

Likely, the easiest means of avoiding losses described above is simply connecting a large series of the arrangement disclosed above. In this way, the surplus pressure in the input subvolume 224 of the output container 206 will not be very large since the temperature change in every step is small, and therefore so is the pressure change.

One alternative is to place a regulating valve at the end of the output 225 of the output container 206, making it possible to connect said output subvolume 225 to a large amount of destinations of descending pressure lower than the heat exchanger 310's pressure. It can be automatically regulated by the difference in pressure between the output subvolume 225 of the input container 205 and the input subvolume 224 of the input container 205, compared to the difference in pressure between the output subvolume 225 of the output container 206 and the input subvolume 224 of the output container 206. These pressure differences may be compared in such a way that when the pressure of the output 225 of the input container 205 becomes too large for the piston 251 to compress it, the difference will automatically adjust the valve to connect the output subvolume 225 of the output container 206 to a destination of lower pressure, thereby increasing the difference in pressure between the input subvolume 225 of the output container 206 and the output subvolume 225 of the output container 206, thereby applying extra force on the piston 251 compressing the gas in the output subvolume 225 of the input container 205.

Since the pressure increase in the output subvolume 225 of the input container 205 is easily predicted due to the decrease in volume, this solution can easily be achieved mechanically by moving an element in the valve connecting the output subvolume 225 of the output container 206 with destinations of different pressures in order to connect said output subvolume 225, in a predefined order, to predefined destinations, due to the piston 251 position indicating the volume, and therefore the pressure, of the output subvolume 225 of the input container 205.

The advantage of this solution is that the surplus pressure created by the heat exchanger 310 will be used to move extra gas to its destination per cycle.

The advantage with the many sub-chamber solution is that less energy is used and also compression is done.

The advantage with the many apparatus solution is that less energy is used. Each of these solutions has its advantages and disadvantages.

The preferred embodiment therefore seeks to meet all the above solutions.

The principle of the heating part of the heating apparatus is designated the heating part. Which embodiment to consider the preferred embodiment depends on the context, therefore two or more embodiments are described in the same section, and when they differ in some way, the difference is further noted.

In a first processing step, the heating part includes two containers assembled as pump elements connected to each other via a heat-exchanger, where the outlet from the first heating-part is connected to the heat exchanger 310 primary inlet and the inlet to the second heating-part is connected to the primary outlet from the heat exchanger 310. The heat exchanger 310 has a secondary inlet and outlet of the fluid from which heat is taken. Said pump element also represents said containers, wherein the left pump element represents the input container 205 and the right pump element represents the output container 206.

The heating part includes one or more pump elements jointly operated by a rotating mechanism and therefore moves synchronously with each other. In the first preferred embodiment, the pumping elements are functionally identical and operate in such a way as to move synchronously. Only one pumping element will be described in detail, but the description for one pumping element also applies to the other. In the second preferred embodiment, the output container 206 is split into smaller several sub-chambers that together have the same volume as the input container 205, each having a piston 251 wall separating every sub chamber into an input sub chamber and an output sub chamber. Said chambers move identically in such a way that they move synchronously with each other and the input container 205. Each sub chamber with its inlets 241, outlets and pistons 251 comprises the same features as the cavity in the input container 205, but further comprises extra outputs periodically connecting the output subvolume 225 of each sub chamber with a different destination volume depending on said piston 251 walls position in the scroll movement. Only one sub chamber will be described in detail, but the description for one sub chamber also applies to other sub chambers.

Referring to FIGS. 19-24, each pump element comprises two mainly parallel side walls, arranged on a frame-bottom. The side walls are at the same time connected with two further mainly horizontal walls (endstops), which are also connected to the frame-bottom. Together said parts form a cavity that can be described to a sealed bowl, and for the sake of simplicity will further be designated bowl in the text.

The frame-bottom rests on a bottom element illustrated symbolically as a rectangle surrounding the whole heating-part. The bottom element is also a visual reference surface to make it clear which parts are moving relative to each other. It need not necessarily take the form of a plate, but is here termed as such.

The upper and lower walls in every bowl is arranged with a gap between the them, so the two side walls and the upper and lower walls in conjunction with frame-bottom defines a bowl open only outwards. This bowl can only be moved vertically in the figure plane.

The frame-bottom is controlled to slide freely only in the vertical direction of the figure plane, and is constantly in contact with the bottom element.

All previously described bowls are connected to each other and therefore move identically.

The bowl upper edge (outwards) is flat, i.e. it has the same height above the plane of the figure. It is slidingly and sealingly connected to a top plate located on top of the bowl. With the top plate superimposed on the bowl, the hitherto open bowl is closed and forms the closed space in which the pumping occurs.

At the top element is attached a piston 251 wall slidingly disposed in the cavity. The piston 251 extends all the way between two interconnected endstops. The piston 251 should be such designed so that it can, with ease, slide laterally in the cavity, from the left end in the figure plane to right end and back. At the same time, it will be sealed tightly enough that no fluid can escape past the side of the piston 251.

By moving the top element, the piston 251 moves in an equivalent manner.

The piston 251 extends all the way between two interconnected endstops, and since the endstops only can move vertically, the movement of the piston 251 wall components extending parallel to the direction in which the bowl can move will be followed by the bowl.

Relative to the bowl, the top plate with piston 251 walls will however only move sideways.

To the cavity is connected an inlet which flows in from a left-hand upper opening in the bottom element. Further, to the cavity is connected an upper outlet, which results in a right-hand top opening in the bottom element.

The container is connected with the bottom element passage which is connecting the two openings via the bottom element, a left-hand lower connection and a right lower connection, where these openings are connected to each other via an internal cross connection. These connections are disposed in the input-containers cavity when said bowl is in a lower position in the figure plane.

When the top plate scrolls the piston 251, and thus moves the bowl up or down in the figure plane, the openings in the frame-bottom will either expose the connections on the bottom element and make the flow through equaled connections possible, or they do not expose the connection and it is blocked.

For example: if the top plate rotates clockwise and starts to go up in an upper position, it defers up the bowl so that the holes 533 touch 502 and 534 touch 503. Since the top plate rotates clockwise the piston will move to the right relative to the cavity, thus sucking fluid via line 501 at the same time as the fluid is ejected from the cavity via line 504.

The top plate continues to turn clockwise and starts to go down in a lower position, thereby moving shoots down the bowl so that the holes 533 touch 510 and 534 touch 509. Since the top plate rotates clockwise the piston in addition will start to move to the left and thus to eject the fluid via line 510, from left to right side of the piston, since 533 and 534 then are connected via passage 506.

This process is described here as a process in five steps with reference to the figures shown in FIG. 19 to FIG. 24. It is assumed for the purpose of this example, that the temperature increase is very large, meaning an output temperature of about twice the absolute temperature of the input temperature of the heat exchanger. The output pressure of the heat exchanger is therefore also assumed to be about twice the pressure of the heat exchanger's input.

Figure 19:
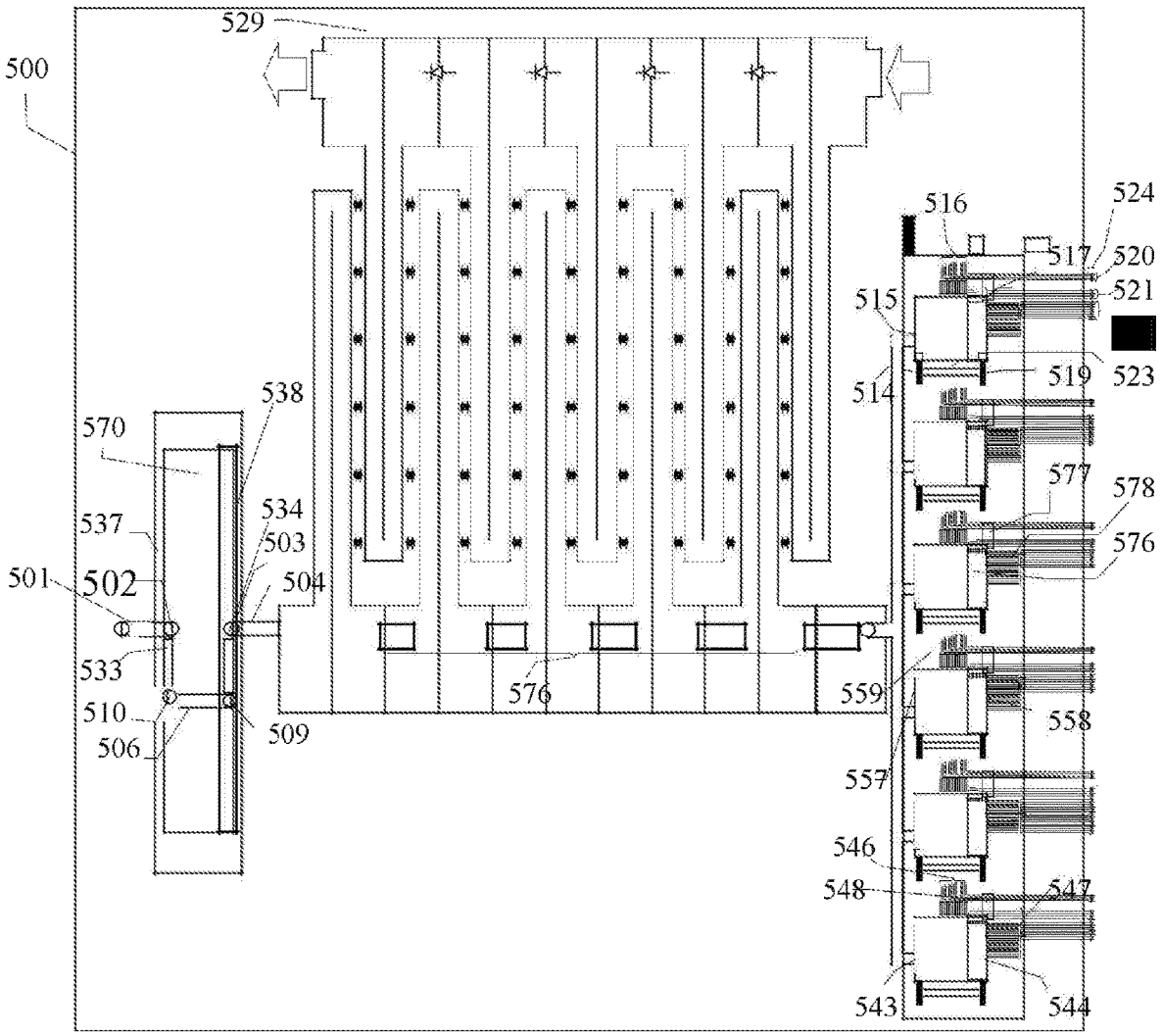
FIG. 19 is a diagram of a first pumping step in one embodiment of the present invention.

In FIG. 19 the pistons 570 (576 in the output container) are in their rightmost position beside the right-side wall 538 (or 558 in the output container), and in its middle vertical position.

In the input container, in this position the piston blocks the right-hand openings (509,503) and the frame-bottom blocks all connections (510,509,502,503).

In the output container, in this position the piston blocks the right-hand openings (519,544,548) and the frame-bottom blocks all connections (514,515,519,544,548).

Figure 20:
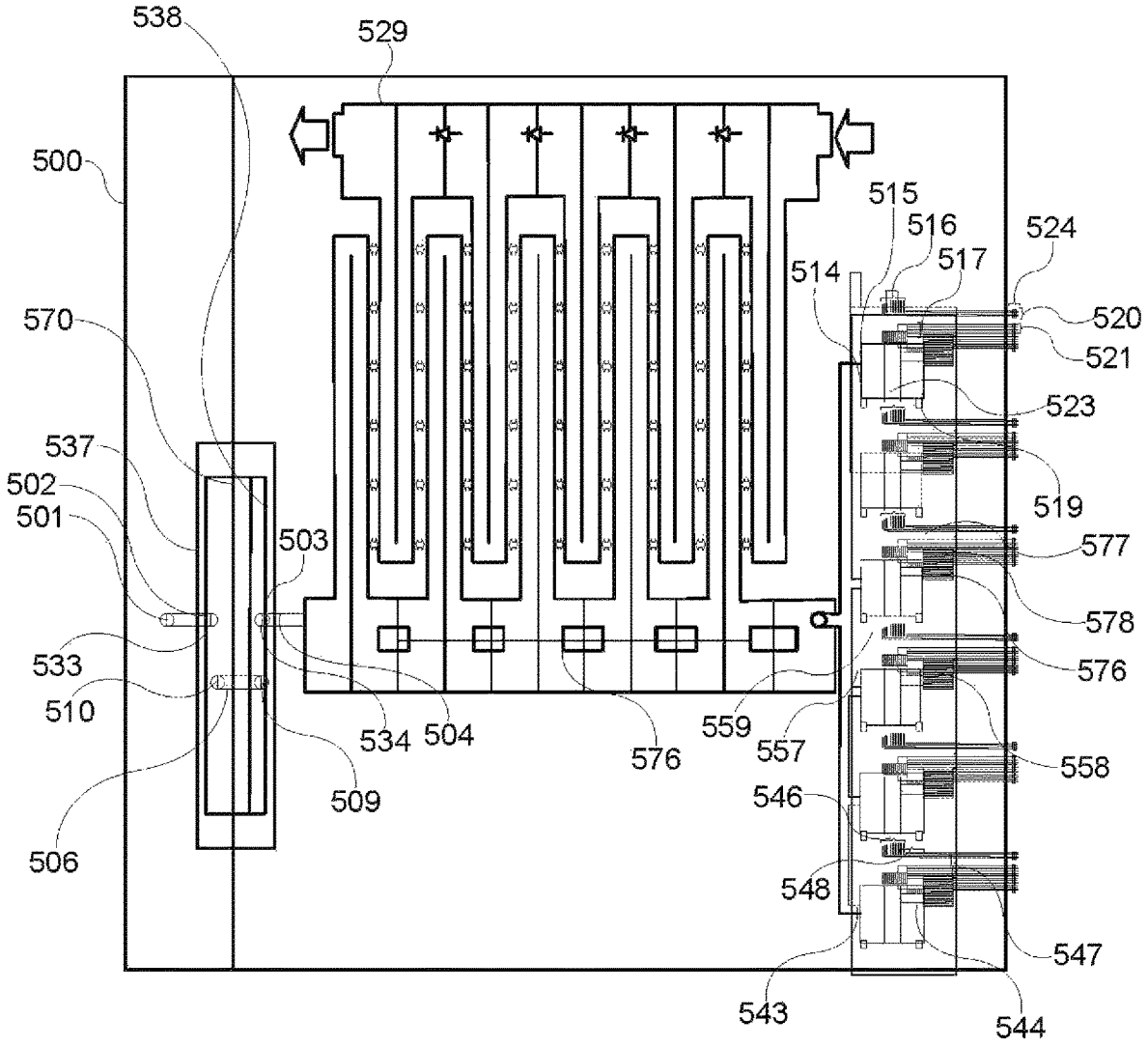
FIG. 20 is a diagram of a second pumping step in one embodiment of the present invention.

FIG. 20 shows a third process step of the preferred embodiment where the pistons 570 (and 576 in the output container) are in a central location between the right-hand and left-hand side walls, but here in its lowest position.

In the input container, the frame-bottom is still blocking the upper connections (502, 503) while the two lower connections (510,509) are exposed by the openings 533 and 534 respectively. This will allow the fluid to pass from the piston wall left side to the right-hand via the internal cross-connection 506.

In the output container, the frame-bottom is still blocking the upper connections (517,515) while the two lower connections (514,519) are exposed by the openings 543 and 544 respectively. This will allow the fluid to pass from the piston wall left side to the right-hand via the internal cross-connection 523.

Figure 21:
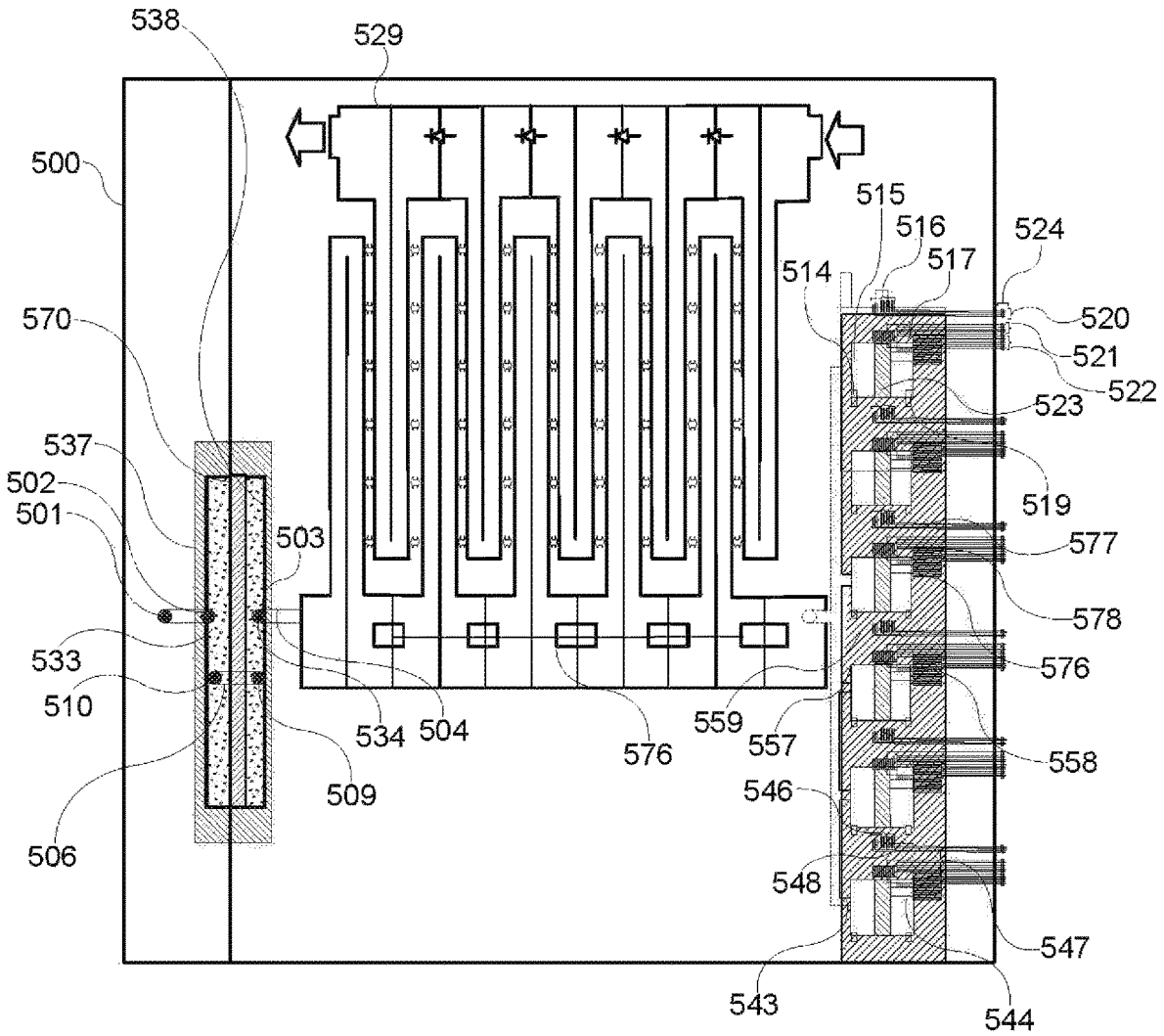
FIG. 21 is a diagram of a third pumping step in one embodiment of the present invention.

FIG. 21 shows a fourth process step of the preferred embodiment where the piston 570 (576 in the output container) are in their leftmost position beside the left sidewall 537 (557 in the output container).

In the input container, the opening 533 is now between the connections 502 and 510, and 534 is between the connections 503 and 509; thus, there is no connection in or out of the cavity. Thus, the frame-bottom blocks the connections 502, 510, 503 and 509. Furthermore, the piston 570 blocks the left-hand outlet openings 502 and 510.

In the output container, the opening 543 is now between 515 and 514, and 544 is not connected to 517 or 519; i.e. the frame-bottom blocks the connections 515, 514, 517 or 519. Furthermore, the piston 576 blocks the left-hand outlet openings 515 and 514.

Figure 22:
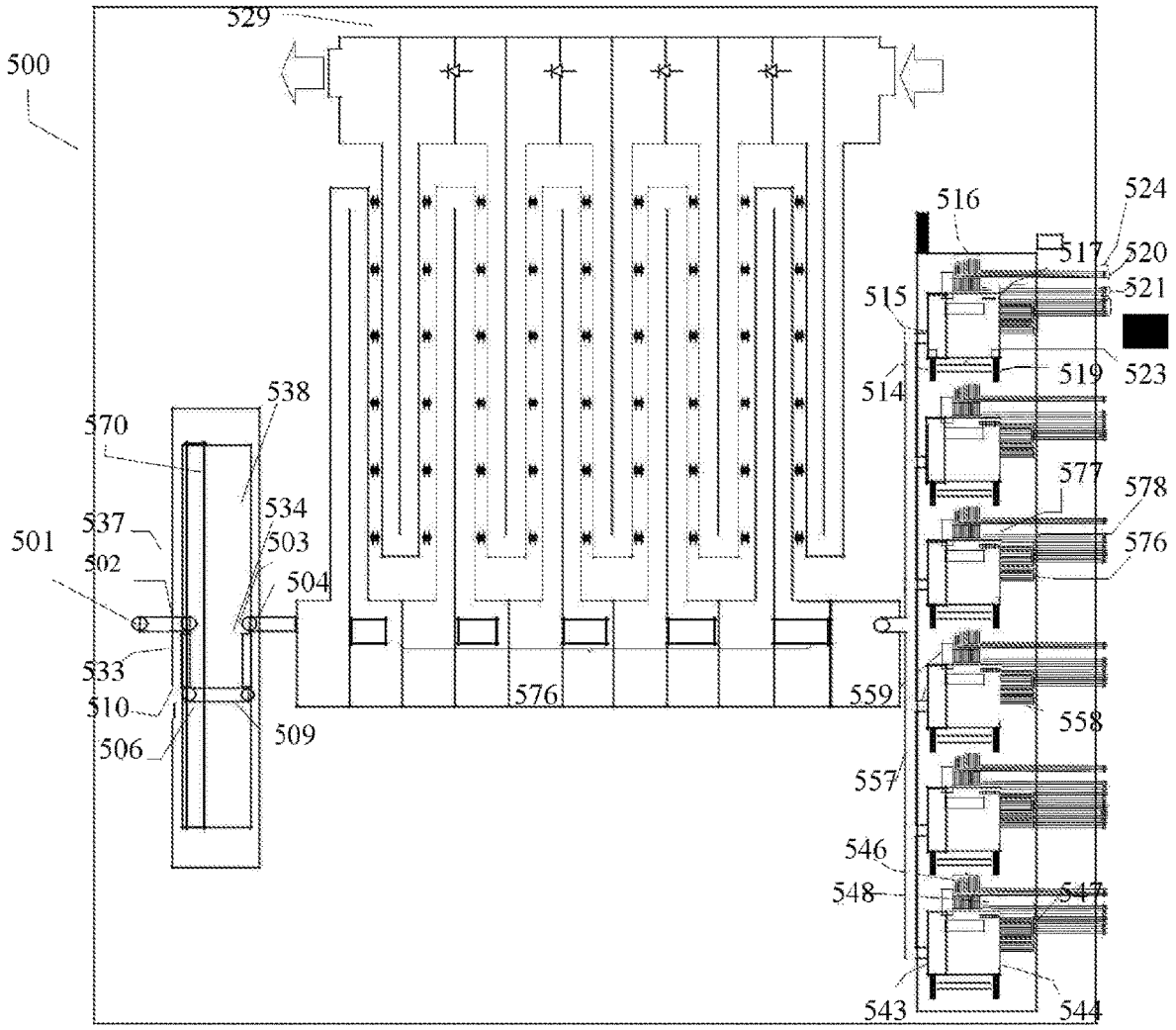
FIG. 22 is a diagram of a fourth pumping step in one embodiment of the present invention.

FIG. 22 shows a fifth process step of the preferred embodiment where the piston 590 travelled to the right from its leftmost position (beside the left sidewall 580) as well as moved slightly up from the previous position.

In the input container, the frame-bottom blocks the two lower connections, while the two upper connections are located in contact with the frame-bottom's openings and thus are not blocked. The piston wall motion to the right then sucks the fluid through the inlet 501 into the cavity's left half and the piston wall tries to move the fluid from the cavities right half into the heat exchanger, but since there is a rectifier connected into the heat exchanger it won't be possible until the output chamber reaches the same pressure as the heat exchanger. Thereby the output chamber of the input container's increasing in pressure. The output chamber of the output container is decreasing in pressure corresponding said increase in pressure. When the frame-bottom moves upwards, the opening array (548) passes by different openings in the array of openings (517) on the bottom element (500), connected to destination volumes (521) of lower and lower pressure, and therefore decrease in pressure.

On the top element (on inner side of the lid) of each sub chamber of the output container, there is a passage (577) on the close right side of the piston. Said passage (577) on the top element of the output chamber of the output container connects said output chamber with a small part of the upper side of the horizontal wall (559).

On each of said upper horizontal wall of each of the sub chambers of the output container, there is an array of openings (546). The openings of said array (546) will further be connected to openings of another array of openings (516) on the bottom element (500). This array of openings (516) is connected to destination volumes (520) of decreasing pressure, in the direction left to right in the drawing.

Therefore, when the frame-bottom move upwards, and the piston moves to the right, said passage (577) passes by different openings connected to destination volumes of lower and lower pressure. Therefore, the output chamber of the output container will decrease in pressure.

It is recommended to configure the connections so that said passage (577) and said array of openings (548) will connect the output chamber of the output container to destination volumes of the same pressure.

All output-arrays (520,521 and 522) of this embodiment are connected via rectifiers (524), so the passage (577) and said opening array (548) can be so wide as to cover several outlets at the time without risking a destination volume of high pressure ejecting gas into a destination volume of low pressure. This improves the speed in which the pressure can be lowered in the output chamber.

Figure 23:
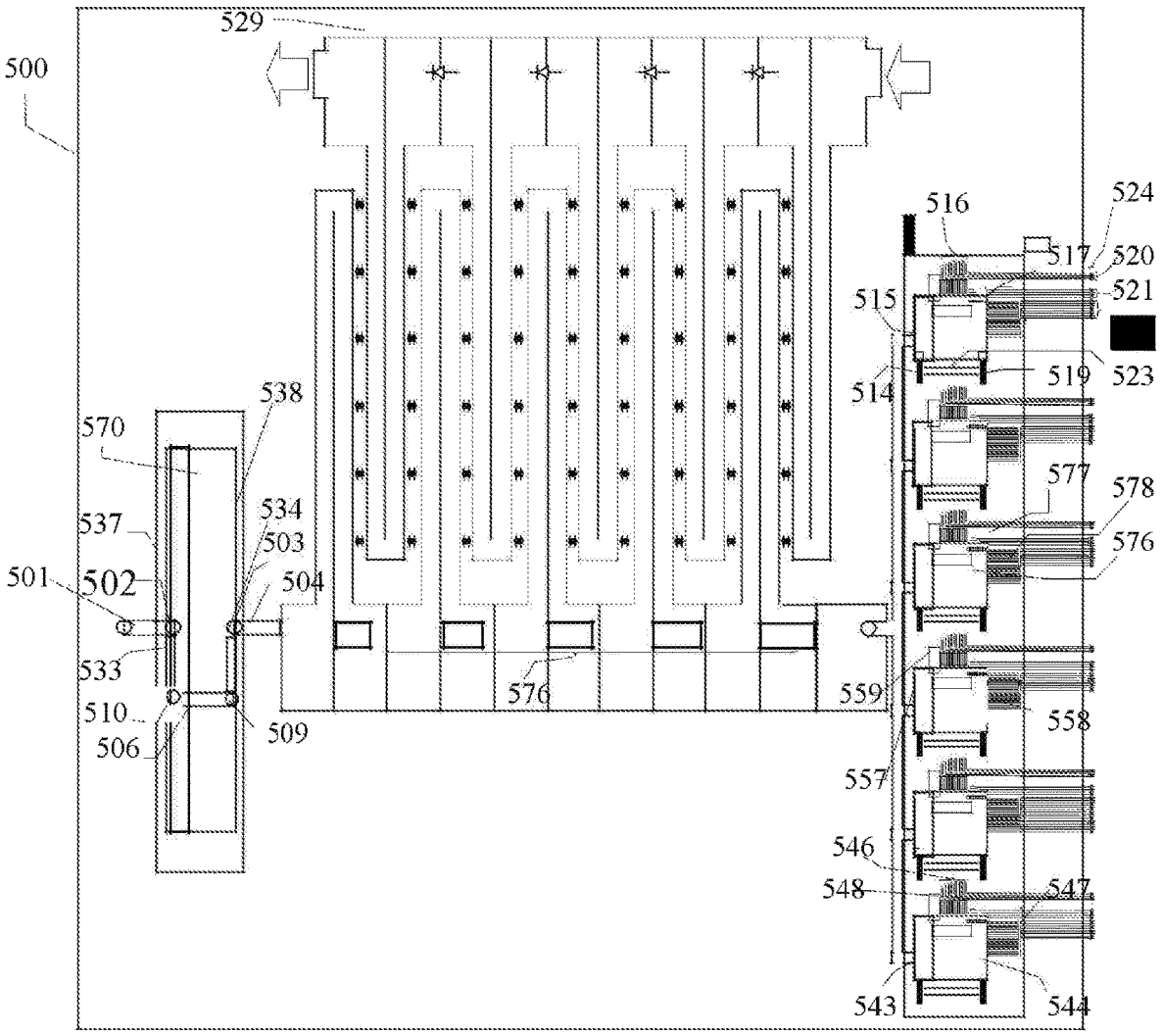
FIG. 23 is a diagram of a fifth pumping step in one embodiment of the present invention.

FIG. 23 shows a fifth process step of the preferred embodiment where the piston 570 (576 in the output container) have moved further to the right and up to its top position.

In the input-container, the lower connections are still blocked and the upper connections are connected to the frame-bottoms openings in the same manner as in the previous figure, so fluid is drawn in through the upper inlet. Thus, since in the beginning of this example the output pressure of the heat exchanger was assumed to be twice the initial input pressure of the input container, and since the volume of the output chamber of the input container by now should be about the same as the heat exchanger, gas can be moved through the upper outlet into the heat exchanger.

In the output-container, the lower connections are still blocked. The opening array (548) is not passing by any openings on the bottom element (500). The passage (577) should have passed by all connections connected to destination volumes of higher pressure. All openings connected to the output chamber of the output container that are passed by from this step, back to the initial step of the cycle (see FIG. 19), should connect said output chamber to a destination of the same pressure as the input pressure of the input container.

Figure 24:
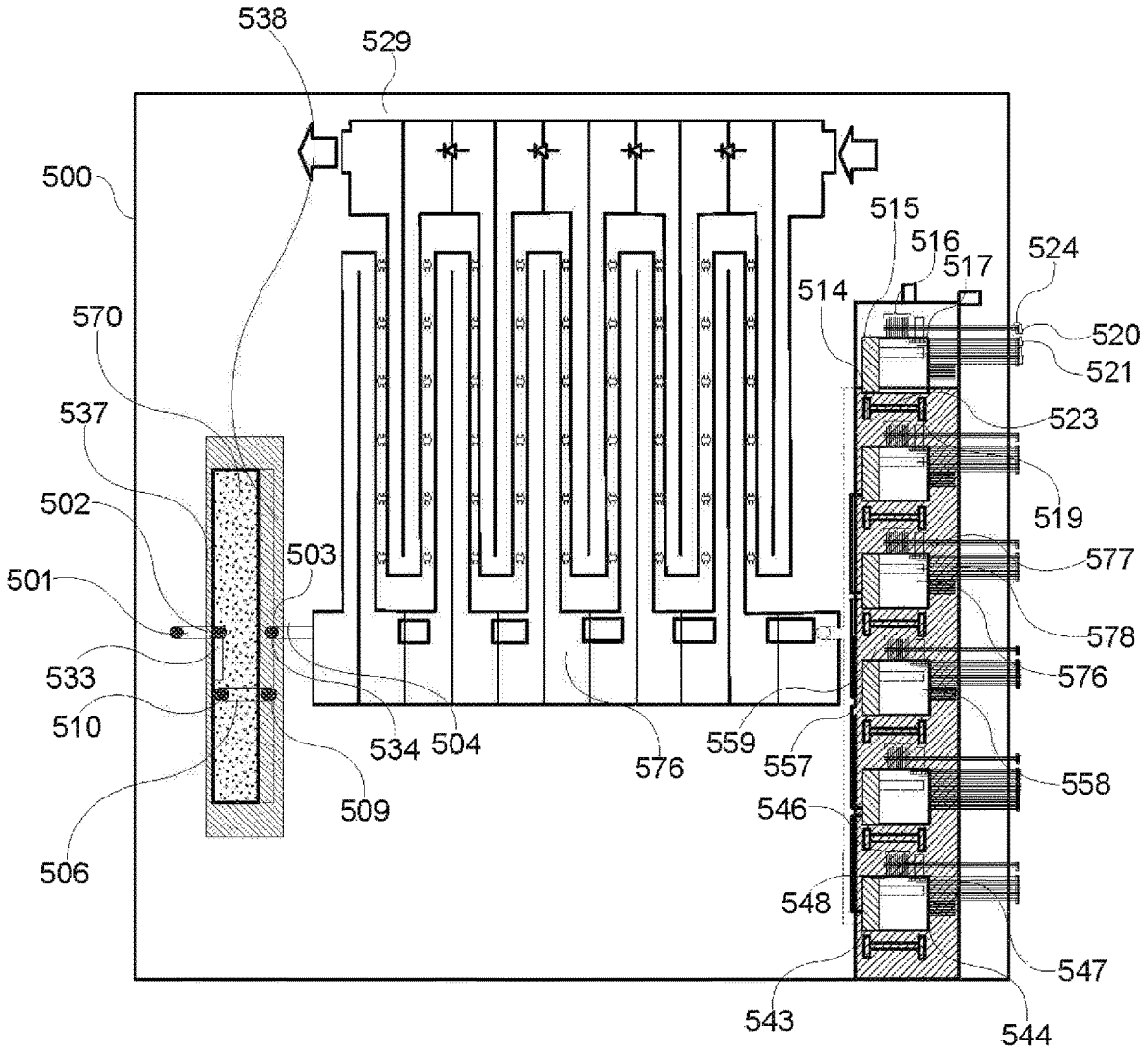
FIG. 24 is a diagram of a sixth pumping step in one embodiment of the present invention.

FIG. 24 shows a sixth process step of the preferred embodiment where the pistons 570 (576 in the output container) have moved further to the right and slightly down from its top position.

In the input container, the lower connections are still blocked and the upper connections are connected to the frame-bottoms openings in the same manner as in the previous figure, so fluid is drawn in through the upper inlet, and gas is moved through the upper outlet into the heat exchanger.

In the output container, the lower connections are still blocked. The opening array (548) is passing by any openings (517) on the bottom element (500) but the opening array (548) but they are blocked by the piston wall (576). Furthermore, there is another horizontally oriented passage (578), similar to the vertically oriented passage (577) described earlier.

On the top element (on the inner side of the lid) of each sub chamber of the output container, there is a horizontally oriented passage (578) on the right side of the piston. Said passage (578) on the top element of the output chamber of the output container, connects said output chamber with a small part of the upper side of the right-side wall (558).

On each of said right side wall of each of the sub chambers of the output container, there is an array of openings (547). The openings of said array (547) will further be connected to openings of another array of openings (517) on the bottom element (500). This array of openings (517) can be connected to destination volumes (522) of decreasing pressure, in the direction top to down in the drawing, but in this example the preferred minimum pressure is already reached and they are only connected to the cooling part.

When the piston wall (576) moves further to the right and down to its middle position it is only ejecting gas to be circulated within the apparatus, not to external flows or volumes.

In the next process step the stage illustrated in FIG. 19 is reached and one cycle is accomplished.

Figure 25:
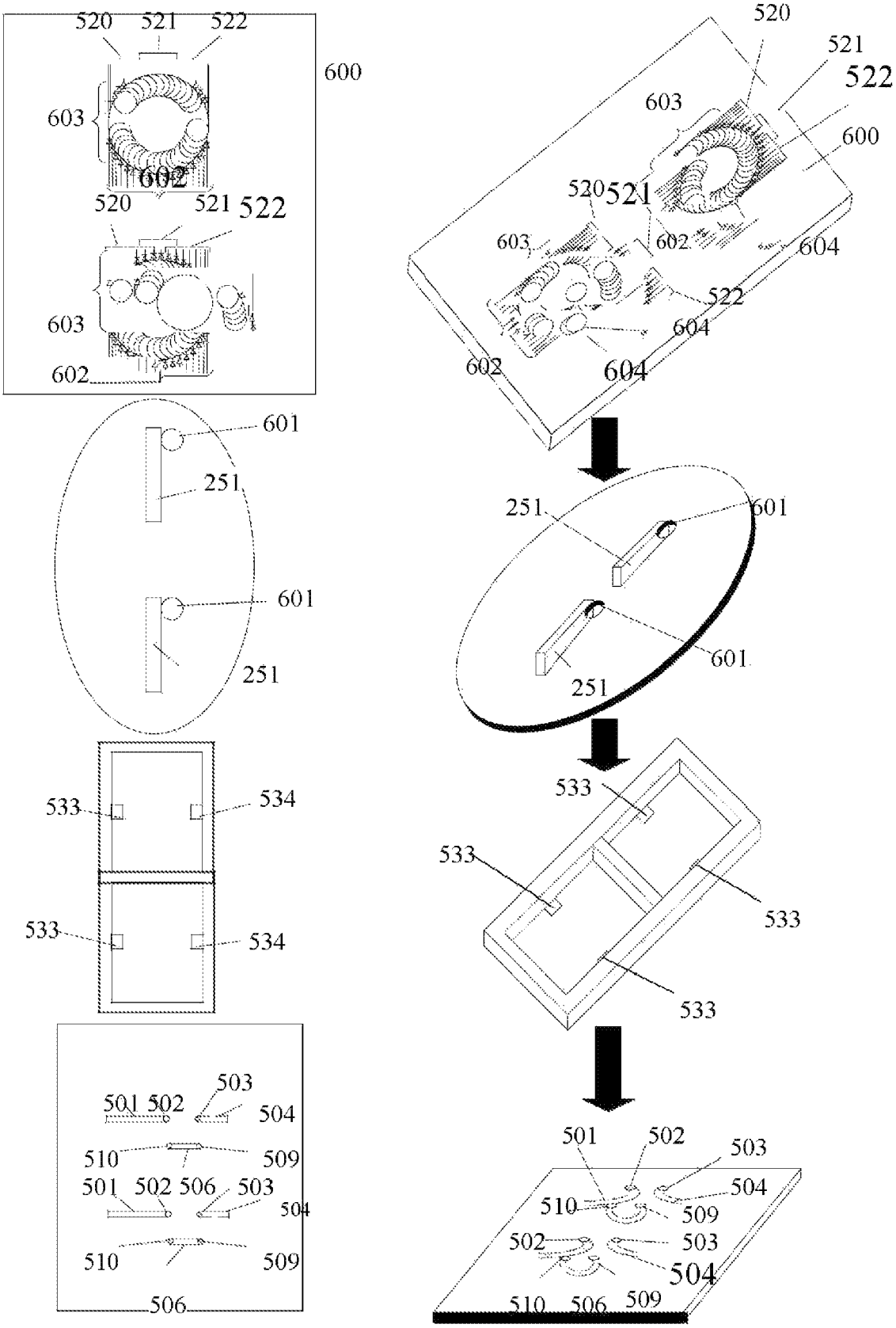
FIG. 25 is a diagram of one embodiment of the pumping mechanism.
Figure 26:
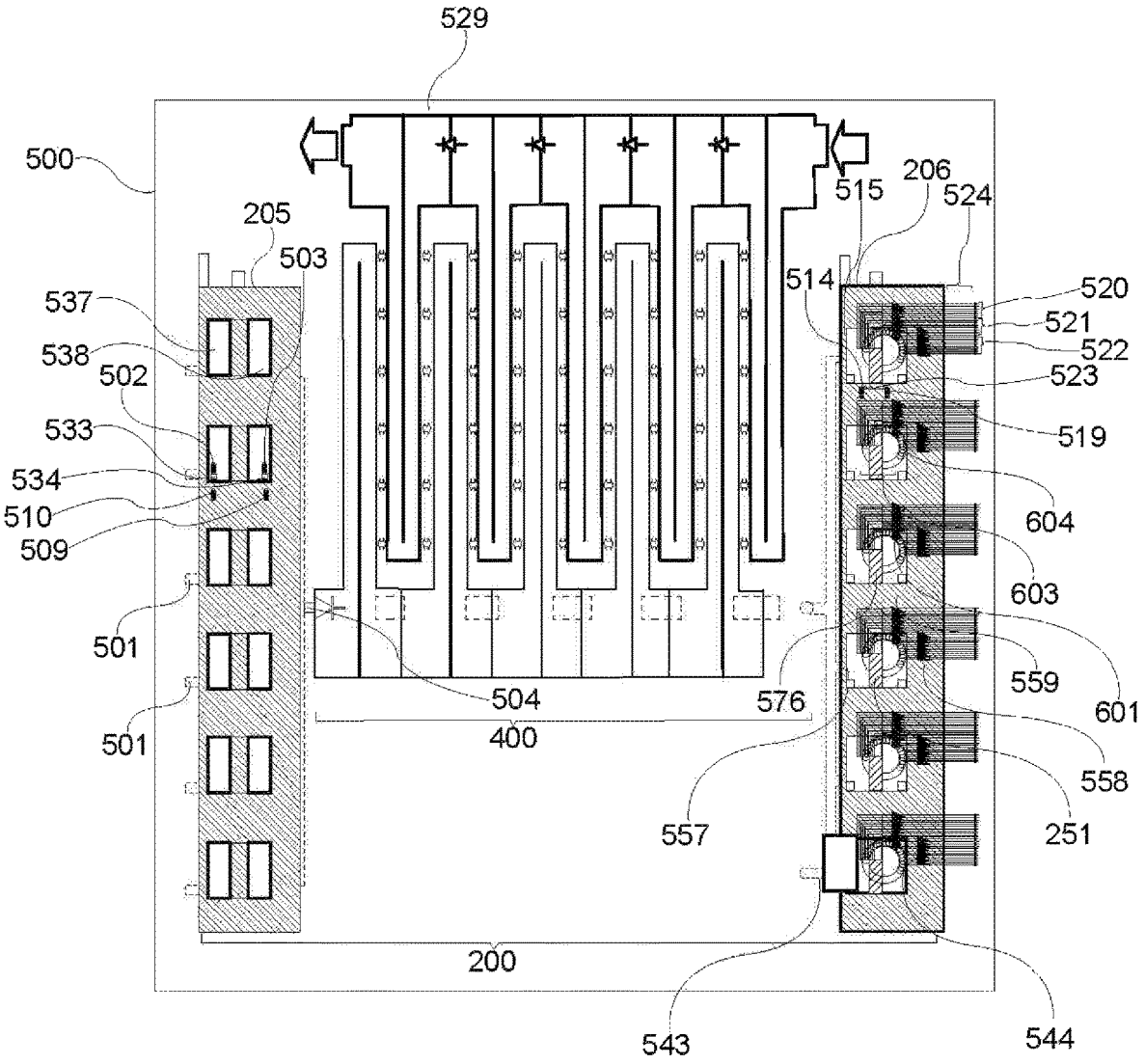
FIG. 26 is a diagram of a further alternate embodiment of the present invention.
Figure 27:
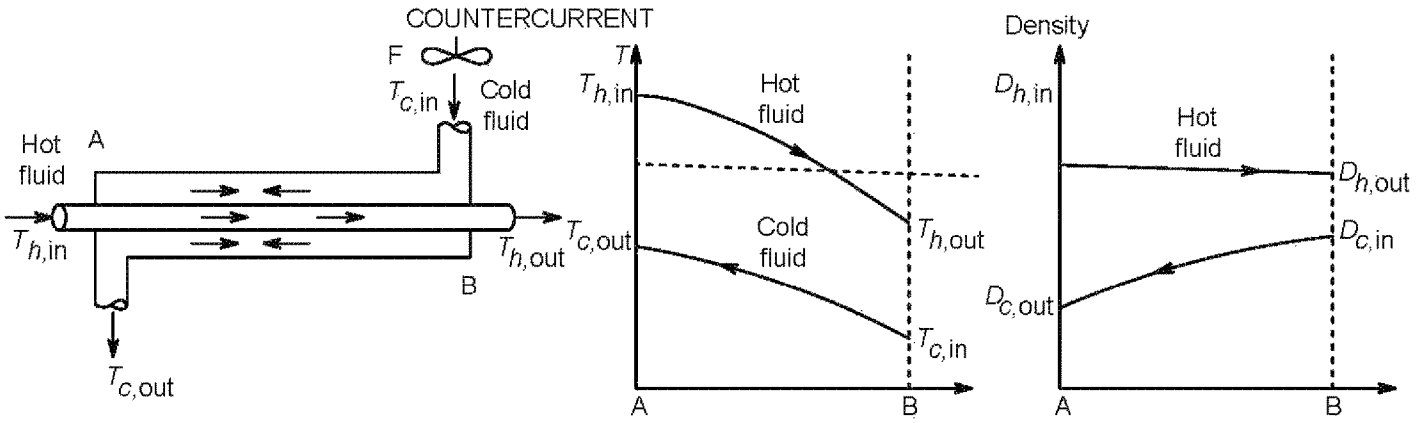
FIG. 27 is a problem explanatory description using a regular CounterFlow Heat exchanger for heating gas.
Figure 28:
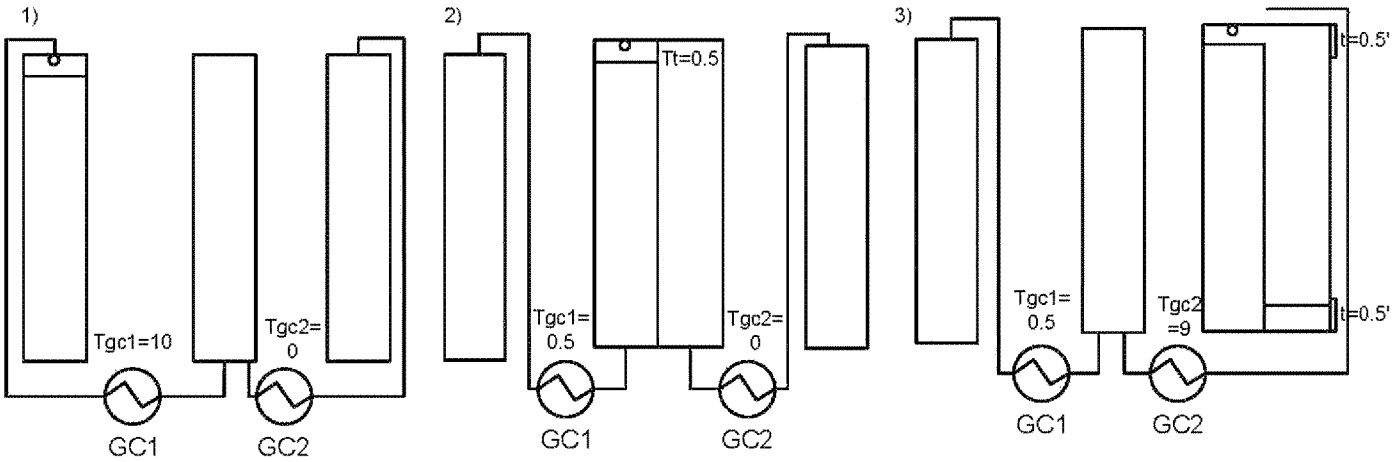
FIG. 28 is a diagram describing the drawbacks with transferring heat with moving liquid.
Figure 29:
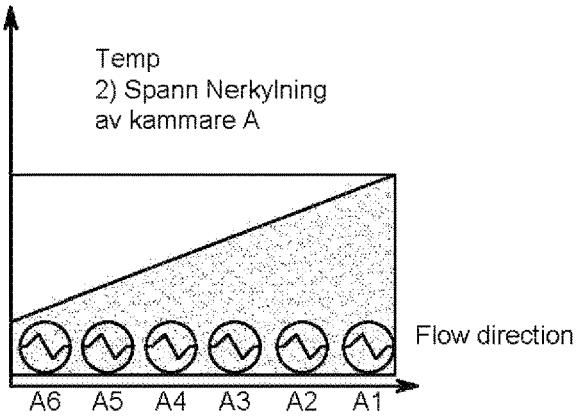
FIG. 29 is a not used diagram describing, the action of flushing liquid through a HE.
Figure 30:
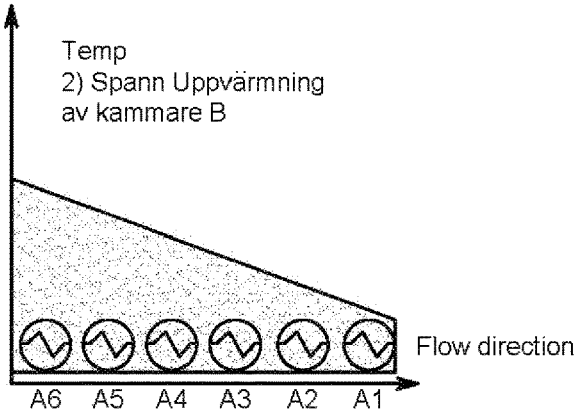
FIG. 30 is a second not used diagram describing, the action of flushing liquid through a HE.
Figure 31:
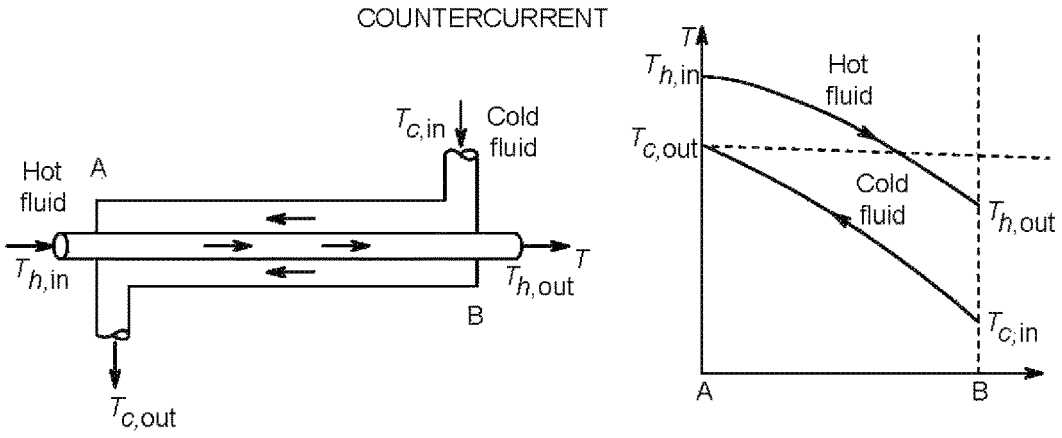
FIG. 31 is a problem explanatory description using a regular CounterFlow Heat exchanger for heating liquid.
Figure 32:
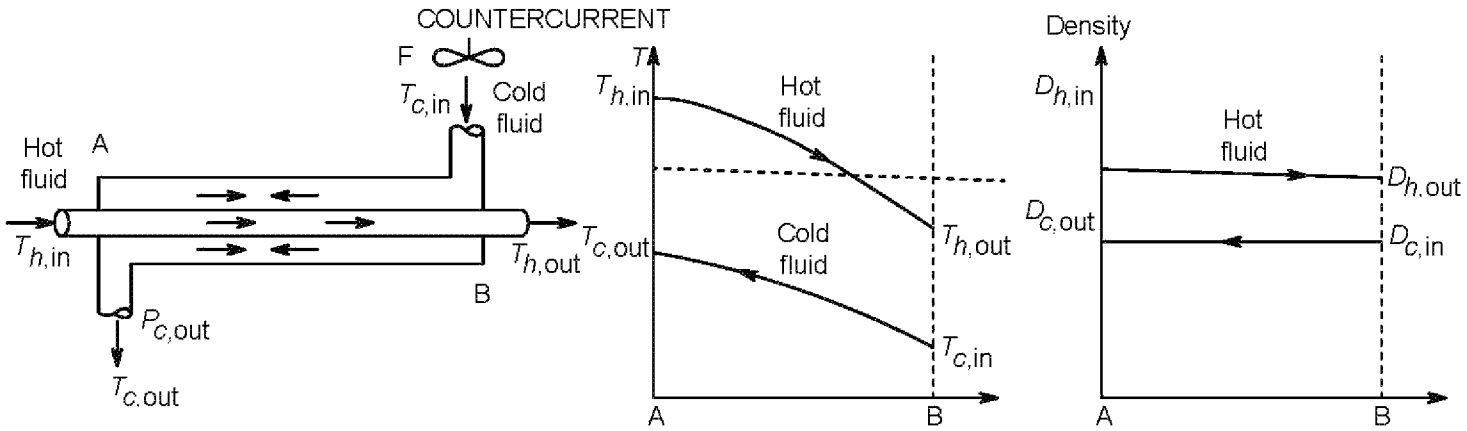
FIG. 32 is a diagram describing the drawbacks with transferring heat only using a fan.
Figure 33:
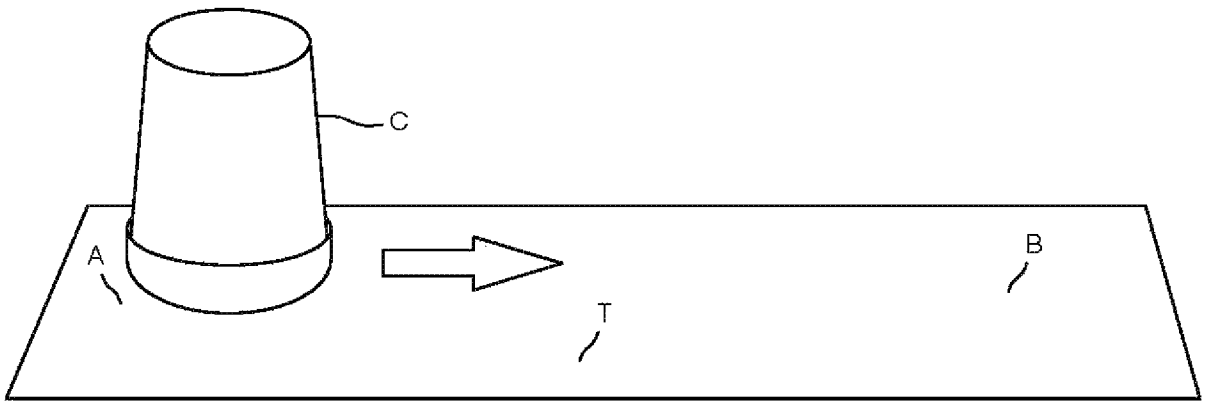
FIG. 33 is a diagram describing the problem of heating gas without heating the used equipments.

An alternative solution for connecting the output chamber of a container to an array of openings is illustrated in FIG. 25, wherein the output chamber has a hole (601) in the top element immediately to the right of the pistonwall (251) in the figure plane. The top element is sealingly and slidingly covered by a, static non-moving, lid comprising an array openings (603). Said hole (601) is sealingly connected to a subset of said array openings (603). The array openings (603) having a suitable shape so that it follows the movement of the hole (601), which in this case means a circular shape, thereby periodically connecting output chamber to a subset, possibly one opening (604), of said array openings, being further connected to other destinations or sources, possibly via rectifiers. In the drawing it is assumed that the hole is connected to sources in the lower half of the array circle and therefore the connections have rectifiers preventing ejections, and the upper half of the array circle have rectifiers preventing injections since it is assumed to be coupled to destinations. There is no preferred solution, since both have benefits and drawbacks, and an extra lid possibly means more friction but on the other hand the alternative solution have a more direct way of connecting the chamber to a destination, making it possible for the passages to be larger and therefore can eject gas faster. If the extra lid is used to connect the container to different destinations, the preferred embodiment can be described referencing FIG. 26, where in the extra lid is transparent only showing the array openings (603) and the top elements lid only showing the hole (601) and piston walls (251). More important, observe that the input container, comprises several sub chambers, with separate inputs but with their outputs connected to the same input of the heat exchanger. The benefits of that will be apparent when the recycling process is described below.

The recycling process is described referencing FIG. 15; by connecting said array of openings (603) to a coupling device (439), dynamically connecting inputs to defined outputs. Following the description above, with the unheated gas pressure coming into the system, having half the pressure compared to the gas exciting the heat exchanger, one can assume it's preferable that the openings (603), being passed until the piston wall has moved about half the way to the right of the chamber, are connected to external destinations (410) of decreasing pressure down to said unheated gas pressure. The following arrays passed by the piston on its way to the right hand wall, should preferably be connected to a large chamber (440), large in a sense that the pressure changed by a containers (262) amount of gas being added or deducted is negligible. The reason for this is that gas is injected asynchronously but ejected synchronously to this chamber (440). This chamber (440) is then connected to a cooling device (420). There is not much reason to make the cooling device as advanced as the heating section (400), even though it can be, so it's shown as regular counter flow heat exchanger in the drawing. The heat emitted by the gas in the cooling device is preferably used to heat up gas in the heating section (400). After the gas is cooled down it's once again directed to a coupling device, from which its again coupled into the heating device (200), since there is less gas coming back to the heating device than exiting, with gas having about the same pressure and temperature as the input gas to the whole system, the returning gas should be directed to a smaller volume, than the summed volume of the output container, in this case somewhere around half the volume. This can be achieved with several smaller containers but in the drawing an input container with six sub chambers is used whereby the returning volume can be adjusted dynamically. Six sub chambers is actually quite a small amount but it's only for descriptive purposes. In the case of half the amount being recycled, three out of six sub chambers should be used. The other three sub chambers should be fed by new external gas of about the same pressure and temperature as the cooled returning gas. This cycle then gives a pump effect without any valves that must be opened or closed. The connections are automatically exposed/blocked by the frame-bottoms and the piston walls' own movements. By placing the array of outlets of the output chamber of the output container, in certain positions, in such a way they get exposed in certain positions of the scrolling pistons movement, and by connecting these positions to a destination volume (with a certain pressure and temperature), you can control the output of the apparatus so that the pressure of the output chamber of the output container decrease gradually in steps to suitably adjust to the increasing pressure in the output chamber of the input container.

The connections shown in the coupling devices (439) are simply exemplary coupling since the coupling devices in this embodiment are dynamic. Furthermore in 439 only the connections for the uppermost chamber are displayed in the drawing for explanatory reasons. In this example, the rest of the output-chambers of the output-container should be coupled the same way, even though not shown in the drawing. For the described embodiment, it is thought that the external outputs (410) should be as many as the number of outlets in the array of outlets for every output chamber. Furthermore, the number of internal outputs (441) should similarly be the same, so that for every input coming from an output chamber, it can be decided whether to connect it to one the external outputs, or one of the internal inputs.

Although the invention has been explained in relation to its preferred embodiment, it is to be understood that many other possible modifications and variations can be made without departing from the spirit and scope of the invention as hereinafter claimed.

What is claimed is:

1. An apparatus for heating gas comprises:

a gradational heat transfer element comprising a gradually increasing temperature traversing along the gradational heat transfer element between a cold end and a hot end of the gradational heat transfer element;

at least one container comprising at least one input and at least one output;

at least one gas volume being sealingly enclosed within the at least one container;

each of the at least one container being configured to advance the at least one gas volume along the gradually increasing temperature from the cold end to the hot end of the gradational heat transfer element, wherein the at least one gas volume is exposed to gradually increasing temperatures from the gradational heat transfer element along the gradually increasing temperature;

the at least one container comprises a series of containers;

each of the series of containers comprises at least one chamber and at least one of the gas volumes;

an arbitrary chamber in the series of containers being configured to direct fluid into a subsequent chamber in the series of containers, wherein the gas volume is defined by the sum of an arbitrary subvolume defined by the arbitrary container and a subsequent subvolume defined by the subsequent chamber, wherein the arbitrary subvolume and the subsequent subvolume are each volume-variable;

the arbitrary chamber and the subsequent chamber each comprise at least one movable element, wherein the movable element controls the size of each of the arbitrary subvolume and the subsequent subvolume;

the movable element being configured to translate within the container for each of the series of containers;

the movable element of the arbitrary container being constrained to move synchronously with the movable element of the subsequent container, wherein fluid is directed from the arbitrary container into the subsequent container through synchronous movement of the movable element of the arbitrary container and of the movable element of the subsequent container;

the series of containers being in unidirectional fluid communication with each other along a fluid flow path;

the fluid flow path being in thermal communication along the gradational heat transfer element;

a first container from the series of containers being in fluid communication with a fluid input line;

a last container from the series of containers being in fluid communication with a fluid output line;

first container being in thermal communication with a coolest portion of the gradational heat transfer element; and the last container being in thermal communication with a warmest portion of the gradational heat transfer element.

2. An apparatus for heating gas, comprising a gradational heat transfer element, having a gradually increasing temperature from a cold end to a hot end a series of containers arranged to comprise the gas to be heated, comprising at least a first and a last container, the first container having a first input for taking in gas to be heated and the last container having a first output for expelling gas, each container comprising at least one chamber having a pumping mechanism for pumping gas between chambers, the pumping mechanism of the chambers in the series of containers being arranged to move synchronously with each other, in such a way that the series of containers are in a unidirectional fluid communication with each other along a fluid flow path, the fluid flow path being in thermal communication with the gradational heat transfer element such that the first container is in thermal communication with a first portion of the gradational heat transfer element and the last container is in thermal communication with a second portion of the gradational heat transfer element, the second portion of having a higher temperature than the first portion.

3. An apparatus according to claim 2, wherein the pumping mechanism comprises a moveable element dividing the chamber into a first and a second subvolume, and configured to translate within the container, thereby controlling the size of each subvolume.

4. The apparatus for heating gas as claimed in claim 3 wherein, the first container being in thermal communication with a coolest portion of the gradational heat transfer element; and the last container being in thermal communication with a warmest portion of the gradational heat transfer element.

5. The apparatus for heating gas as claimed in claim 3, wherein at least one of the series of containers is positionally fixed along the gradational heat transfer element.

6. The apparatus for heating gas as claimed in claim 3, wherein at least one of the series of containers are isolated from the gradational heat transfer element.

7. The apparatus for heating gas as claimed in claim 3, wherein the change in volume of the subsequent subvolume is at least the same as the change in volume of the arbitrary subvolume multiplied by the pressure in the arbitrary subvolume divided by the pressure in the subsequent subvolume.

8. The apparatus for heating gas as claimed in claim 3, wherein the gas volumes are constant in size.

9. The apparatus for heating gas as claimed in claim 3 comprises:

a fluid flow rectifier;

and the arbitrary sub volume being connected to the subsequent subvolume through the fluid flow rectifier.

10. The apparatus for heating gas as claimed in claim 3 comprises:

an output subvolume of an arbitrary chamber being in fluid communication with a cooler end of a heat exchanger;

a warmer end of the heat exchanger being in fluid communication with an input subvolume of a subsequent chamber;

and the heat exchanger being in thermal communication with a span of the gradational heating element.

11. The apparatus for heating gas as claimed in claim 3 comprises:

each of the series of containers comprises a piston as the movable element;

the piston being configured to translate reciprocatingly within the container for each of the series of containers; and the piston of an arbitrary container from the series of containers being constrained to move synchronously with the piston of a subsequent container from the series of containers, wherein fluid is directed from the arbitrary container into the subsequent container through synchronous movement of the piston of the arbitrary container and of the piston of the subsequent container.

12. The apparatus for heating gas as claimed in claim 10 comprises:

the heat exchanger being configured to prevent cold gas from mixing with hot gas within the heat exchanger;

the heat exchanger being connected between an outlet of the arbitrary container and an inlet of the subsequent container;

the heat exchanger having significantly larger volume than the arbitrary container and the subsequent container; and an input connection and an output connection of the heat exchanger being openable, wherein pressure equalization between the arbitrary chamber, the heat-exchanger and the subsequent chamber is achieved before gas movement is performed, wherein the volume moved into the cold end of the heat exchanger from the arbitrary container is equivalent to the volume being moved out from the hot end of the heat exchanger to a destination subsequent container when gas movement is performed.

13. The apparatus for heating gas as claimed in claim 12 comprises:

an openable cold connection between the cold end of the heat exchanger and the arbitrary chamber, wherein the pressure equalization is achieved through a portion of gas being ejected from the cold end of the heat exchanger into the arbitrary chamber through the openable cold connection, thereby pressurizing the arbitrary chamber.

14. The apparatus for heating gas as claimed in claim 12 comprises:

an openable hot connection between the hot end of the heat exchanger and the subsequent chamber, wherein the pressure equalization is achieved through a portion of gas being ejected from the hot end of the heat exchanger into the subsequent chamber through the openable hot connection, thereby pressurizing the arbitrary chamber through synchronous movement of the movable element of the arbitrary chamber and of the movable element of the subsequent chamber.

15. The apparatus for heating gas as claimed in claim 12, wherein the heat exchanger is configured to prevent cold gas from mixing with hot gas through a plurality of narrow passages between the cold end and the hot end of the heat exchanger.

16. The apparatus for heating gas as claimed in claim 12, wherein the heat exchanger is configured to prevent cold gas from mixing with hot gas through a series of heat exchanger chambers, wherein the series of heat exchanger chambers increases incrementally in temperature, wherein the series of heat exchanger chambers are separated by openable heat exchanger connections, wherein the openable heat exchanger connections are configured to be opened in sequential order from an output heat exchanger chamber of the series of heat exchanger chambers to an input heat exchanger chamber of the series of heat exchanger chambers.

17. The apparatus for heating gas as claimed in claim 14 comprises:

the gas being restricted from moving from the cold end of the heat exchanger to the arbitrary container; and the subsequent chamber having smaller volume than the arbitrary chamber.

18. The apparatus for heating gas as claimed in claim 3 comprises:

a last container from the series of containers; and a gas ejection apparatus.

19. The apparatus for heating gas as claimed in claim 18 comprises:

the gas ejection apparatus comprises a series of destination volumes, wherein the series of destination volumes decrements in pressure from a first destination volume to a last destination volume;

the last container being configured to eject a gas volume into the first destination volume; and the series of destination volumes being configured to transfer the gas volume from the first destination volume through the series of destination volumes to the last destination volume.

20. The apparatus for heating gas as claimed in claim 18 comprises:

a fluid flow rectifier;

the arbitrary subvolume being connected to the subsequent subvolume through the fluid flow rectifier;

the arbitrary subvolume being in periodic fluid communication with the subsequent subvolume through a heat exchanger;

the heat exchanger being in thermal communication with a span of the gradational heating element;

the gas ejection apparatus comprises an array of outputs, wherein the gas ejection apparatus is connected to the output subvolume of the subsequent subvolume; and wherein the gas ejection apparatus is configured such that the output chamber of the subsequent container is connected to outputs of decreasing pressure according to the change of pressure of the output chambers of the arbitrary container.

21. The apparatus for heating gas as claimed in claim 18 comprises:

a gas cooling apparatus comprising a cooling input, a cooling output, and a cooling element;

a last destination volume being configured to transfer an excess gas volume into the cooling input of the gas cooling apparatus; and the gas cooling apparatus being configured to transfer the excess gas volume from the cooling input to the cooling output across the cooling element.

22. The apparatus for heating gas as claimed in claim 21 comprises:

a first container from the series of containers; and a gas injection apparatus.

23. The apparatus for heating gas as claimed in claim 22 comprises:

the gas injection apparatus comprises a series of input volumes, wherein the series of input volumes increases in pressure from a first input volume to a last input volume;

the series of input volumes being configured to transfer the excess gas volume from the first input volume through the series of input volumes to the last input volume; and the last input volume being configured to inject the excess gas volume into the first container.

24. The apparatus for heating gas as claimed in claim 22 comprises:

a transfer volume comprising: an inlet and an outlet for receiving and transmitting from other parts of said apparatus for heating gas; and an outlet for transmitting to other parts of said apparatus for heating gas, wherein the gas injection apparatus is connected to said transfer volume;

wherein the gas injection apparatus comprises an array of inputs; and wherein the gas injection apparatus is configured such that the transfer volume is connected to inputs of increasing pressure, while being disconnected from other parts of said apparatus for heating gas; and the transfer volume being configured to inject the gas volume into the first container.

25. An apparatus according to claim 3, wherein the subvolumes are configured to alternatingly receive and discharge gas, wherein an arbitrary subvolume, having a subsequent subvolume, are configured to let the arbitrary subvolume discharge gas by connecting it to the receiving subsequent subvolume, while disconnecting the arbitrary subvolume from its designated inputs, while disconnecting the subsequent subvolume from its designated outputs while decreasing the arbitrary subvolume and increasing the subsequent subvolume with the moveable elements.

26. An apparatus according to claim 3, wherein

The apparatus is configured make the subvolumes to alternatingly receive and discharge gas, an arbitrary subvolume discharges gas when its subsequent subvolume receives gas, and the arbitrary subvolume receives gas when its subsequent subvolume discharges gas alternatingly, wherein fluid is directed from the arbitrary subvolume into its subsequent subvolume through synchronous movement of the movable element of the arbitrary subvolume and of the movable element of the subsequent subvolume, so as to decrease the arbitrary subvolume while increasing the subsequent subvolume;

while the arbitrary subvolume is connected to the subsequent subvolume;

while the arbitrary subvolume is disconnected from its designated inputs;

and while the subsequent subvolume is disconnected from its designated outputs.

27. An apparatus according to claim 12, wherein the arbitrary chamber and subsequent chamber;

are not in thermal communication with a gradational heat transfer elements.

28. An apparatus for heating gas, comprising a gradational heat transfer element, having a gradually increasing temperature from a cold end to a hot end a series of containers arranged to comprise the gas to be heated, comprising at least one chamber, a first chamber having a first input for taking in gas to be heated and a last chamber having a first output for expelling gas, each chamber having a pumping mechanism for pumping gas between the chambers, the pumping mechanism of the chambers in the series of containers being arranged to move synchronously with each other, in such a way that the series of containers are in a substantially unidirectional fluid communication with each other along a fluid flow path;

wherein the pumping mechanism comprises a moveable element dividing the chamber into an input and an output subvolume, and configured to translate within the chamber, thereby controlling the size of each subvolume, so as to decrease the a second subvolume by increasing the input subvolume and vise versa;

further comprising:

the output subvolume of the first chamber being in fluid communication with a cooler end of a heat exchanger, configured to prevent cold gas and hot gas from mixing in the fluid flow path passing through the heat exchanger;

a warmer end of the heat exchanger being in fluid communication with an input subvolume of the last chamber; and the heat exchanger being in thermal communication with a span of the gradational heating element to substantially pressure equalize the gas between the output subvolume, the heat exchanger and the input subvolume;

and wherein the apparatus is configured to first substantially pressure equalize the gas between the output subvolume, the heat exchanger and the input subvolume, where after gas is moved into the cold end of the heat exchanger, and out of the warmer end of the heat exchanger, by decreasing the output subvolume while increasing the input subvolume with the moveable elements.

29. The apparatus for heating gas as claimed in claim 25 comprises:

an openable cold connection between the cold end of the heat exchanger and the output subvolume, wherein the apparatus is configured to achieve the pressure equalization through a portion of gas being ejected from the cold end of the heat exchanger into the output subvolume.

30. The apparatus for heating gas as claimed in claim 25 comprises:

an openable cold connection between the cold end of the heat exchanger and the output subvolume, wherein the apparatus is configured to achieve the pressure equalization through a portion of gas being ejected from the hot end of the heat exchanger into the input subvolume, while the openable cold connection is closed, and while decreasing the output subvolume and increasing the input subvolume with the moveable elements.

31. The apparatus for heating gas as claimed in claim 25, wherein the heat exchanger is configured to prevent cold gas from mixing with hot gas through a plurality of narrow passages between the cold end and the hot end of the heat exchanger.

32. The apparatus for heating gas as claimed in claim 25 wherein the heat exchanger is configured to prevent cold gas from mixing with hot through a series of heat exchanger subvolumes, wherein the series of heat exchanger subvolumes increases incrementally in temperature along the fluid flow path, wherein the series of heat exchanger subvolumes are separated by openable heat exchanger connections, and wherein the openable heat exchanger connections are configured to be opened in reverse sequential order, starting from a openable connection of the last subvolume, to be passed in the fluid flow path through the heat exchanger subvolumes, and ending with the openable connection of the first subvolume.

33. An apparatus for heating gas, comprising a gradational heat transfer element, having a gradually increasing temperature from a cold end to a hot end;

a series of containers arranged to comprise the gas to be heated, comprising at least a first and a last container, the first container having a first input for taking in gas to be heated and the last container having a first output for expelling gas, each container comprising at least one subvolume having a pumping mechanism for pumping gas between subvolumes;

the pumping mechanism of the subvolumes in the series of containers being arranged to move synchronously with each other, in such a way that the series of containers are in a unidirectional fluid communication with each other along a fluid flow path, the fluid flow path being in thermal communication with the gradational heat transfer element such that the first container is in thermal communication with a first portion of the gradational heat transfer element and the last container is in thermal communication with a second portion of the gradational heat transfer element, the second portion of having a higher temperature than the first portion.

* * * * *